US006558880B1

(12) United States Patent
Goswami et al.

(10) Patent No.: US 6,558,880 B1
(45) **Date of Patent: *May 6, 2003**

(54) THERMALLY DEVELOPABLE IMAGING MATERIALS CONTAINING HEAT-BLEACHABLE ANTIHALATION COMPOSITION

(75) Inventors: Ramanuj Goswami, Webster, NY (US); William D. Ramsden, Afton, MN (US); Paul A. Zielinski, Rochester, NY (US); David G. Baird, Woodbury, MN (US); LuAnn K. Weinstein, Rochester, NY (US); Margaret J. Helber, Rochester, NY (US); Doreen C. Lynch, Afton, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/875,772

(22) Filed: Jun. 6, 2001

(51) Int. Cl.[7] ..... G03C 1/498; G03C 1/83

(52) U.S. Cl. ..... 430/350; 430/339; 430/343; 430/507; 430/510; 430/513; 430/517; 430/519; 430/522; 430/619; 430/964

(58) Field of Search ..... 430/350, 619, 430/944, 510, 343, 513, 339, 522, 519, 517, 507, 613, 964, 600.1, 584, 577, 583; 252/587, 582, 588, 589

(56) References Cited

U.S. PATENT DOCUMENTS

| | | | | |
|---|---|---|---|---|
| 3,745,009 A | | 7/1973 | Jenkins et al. | |
| 4,033,948 A | | 7/1977 | Brown | |
| 4,088,497 A | | 5/1978 | Brown et al. | |
| 4,153,463 A | | 5/1979 | Lea | |
| 4,196,002 A | | 4/1980 | Levinson et al. | |
| 4,201,590 A | | 5/1980 | Levinson et al. | |
| 4,283,487 A | | 8/1981 | Lea et al. | |
| 4,358,529 A | | 11/1982 | Abele | |
| 4,581,323 A | | 4/1986 | Fisher et al. | |
| 5,451,494 A | * | 9/1995 | Diehl et al. | 430/522 |
| 5,652,091 A | | 7/1997 | Perry et al. | |
| 5,672,562 A | | 9/1997 | Goswami et al. | |
| 5,693,589 A | | 12/1997 | Goswami et al. | |
| 5,705,323 A | | 1/1998 | Perry et al. | |
| 6,297,001 B1 | | 10/2001 | Takiguchi et al. | |
| 6,455,210 B1 | * | 9/2002 | Irving et al. | 430/21 |

FOREIGN PATENT DOCUMENTS

| | | |
|---|---|---|
| EP | 1 217 431 A2 | 6/2002 |
| GB | 2 004 380 A | 3/1979 |
| GB | 2 054 184 A | 2/1981 |

OTHER PUBLICATIONS

U.S. pat. application Ser. No. 09/731,373 filed Dec. 6, 2000, titled *An Aqueous Thermally Bleachable Composition Useful In A Photothermaographic Element*, by Irving et al.

* cited by examiner

*Primary Examiner*—Thorl Chea
(74) *Attorney, Agent, or Firm*—J. Lanny Tucker; Louis M. Leichter

(57) ABSTRACT

Photothermographic materials comprise heat-bleachable antihalation compositions in backside antihalation layers. These compositions comprise a hexaarybiimidazole and an oxonol dye that can be represented by the following Structure I:

$$A_1{=}L_1{-}(L_2{=}L_3)_p{-}(L_4{=}L_5)_q{-}(L_6{=}L_7)_r{-}A_2^-(M)_k$$

wherein $A_1$ and $A_2$ are the same or different activated methylene moieties, $L_1$ through $L_7$ independently represent a substituted or unsubstituted methine group, M represents a counterion, k is the number of M counterions necessary to provide neutral charge for Structure I, p, and q, are independently 0 or 1, and r is 0, 1, or 2. The antihalation composition is typically bleached when subjected to a temperature of at least 90° C. for at least 0.5 seconds.

37 Claims, No Drawings

THERMALLY DEVELOPABLE IMAGING MATERIALS CONTAINING HEAT-BLEACHABLE ANTIHALATION COMPOSITION

FIELD OF THE INVENTION

This invention relates to heat-bleachable antihalation compositions and their use in thermally developable imaging materials such as photothermographic materials. More particularly, it relates to photothermographic imaging materials that comprise a heat-bleachable antihalation composition, and have improved keeping stability. The invention also relates to methods of imaging using these materials. This invention is directed to the photothermographic imaging industry.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver " materials, generally comprise a support having coated thereon: (a) photosensitive catalyst (such as silver halide) that upon such exposure provides a latent image in exposed grains that are capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, Research Disclosure, June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Usanov et al., *J. Imag. Sci. Tech.* 1996, 40, 104]. Alternatively, a portion of the reducible silver ions can be completely converted to silver halide, and that portion can be added back to the source of reducible silver ions (see Usanov et al., International Conference on Imaging Science, 7–11 September 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids." Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

Moreover, in photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, Zou et al., *J. Imaging Sci. Technol.* 1996, 40, pp. 94–103, and in M. R. V. Sahyun, *J. Imaging Sci. Technol.* 1998, 42, 23.

Problem to be Solved

The photothermographic materials described above generally comprise one or more "antihalation" compounds or compositions that absorb reflected, transmitted or scattered light so the light does not cause unwanted exposure some distance laterally from the original point of exposure. Such unwanted exposure can render small image "halos" around imaged areas, reducing image sharpness. The antihalation compounds may also be known as "filter" dyes.

The most common use of antihalation compounds is in a layer on the backside of the support. Because many photothermographic materials are exposed at visible wavelengths, the antihalation compounds are necessarily colored. Thus, they must be rendered substantially transparent (for example, bleached or removed) during thermal development so they do not affect the appearance of the resulting image. A variety of dyes have been reported in the literature as useful as antihalation compounds in photothermographic materials. Such compounds generally include particular heat-bleachable dyes, or incorporated addenda that can act as bleaching agents.

For example, the use of radicals from biimidazoles (specifically hexaarylbiimidazoles) in antihalation compositions is described in U.S. Pat. No. 4,196,002 (Levinson et al.) and U.S. Pat. No. 4,201,590 (Levinson et al.). The described compositions become colorless upon heat exposure for a given time. The compositions also include filter dyes that are used in reactive association with certain hexaarylbiimidazoles that contain alkyl substituents. The filter dyes are primarily formazan dyes.

Similar heat-bleachable compositions are described in U.S. Pat. No. 5,672,562 (Goswami et al.) and U.S. Pat. No. 5,705,323 (Perry et al.) in which specific hexaarylbiimidazoles are used in combination with formazan dyes to reduce the time and temperatures required for bleaching. Similar advantages are provided from the use of an acidic layer adjacent the antihalation layer, as described in U.S. Pat. No. 5,652,091 (Perry et al.).

While the compounds described in the cited art are useful for their intended purpose, there is a continuing need to provide more useful antihalation compositions containing dyes with more complete bleaching (lower residual densities after bleaching) and with better storage properties.

SUMMARY OF THE INVENTION

This invention provides a heat-bleachable antihalation composition comprising:

a) a hexaarylbiimidazole, and b) an oxonol dye is represented by the following Structure I:

$$A_1{=}L_1{-}(L_2{=}L_3)_p{-}(L_4{=}L_5)_q{-}(L_6{=}L_7)_r{-}A_2{-}(M)_k$$

wherein $A_1$ and $A_2$ are the same or different activated methylene moieties, $L_1$ through $L_7$ independently represent a substituted or unsubstituted methine group, M represents a counterion, k is the number of M counterions necessary to provide neutral charge for Structure I, p and q are independently 0 or 1, and r is 0, 1, or 2.

In preferred embodiments, the oxonol dyes useful in the antihalation compositions can be represented by the following Structure I-A, I-B, or I-C:

I-A

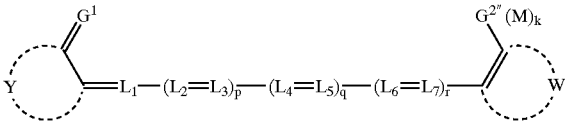

I-B

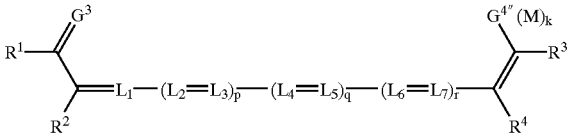

I-C

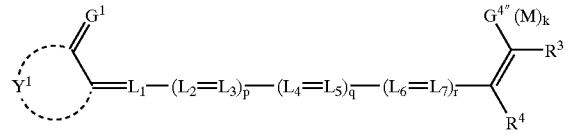

wherein Y, W, and $Y^1$ independently represent the non-metallic atoms necessary to form carbocyclic or heterocyclic rings, $R^1$ and $R^3$ are independently carbocyclic or heterocyclic aromatic groups, $R^2$ and $R^4$ are independently electron-withdrawing groups, $G^1$, $G^2$, $G^3$, and $G^4$ are independently oxygen or a dicyanomethylene group, and p is 1.

Still further preferred embodiments of the antihalation composition can include an oxonol dye that has a $\lambda_{max}$ of at least 400 nm and is represented by the following Structure II or III:

II

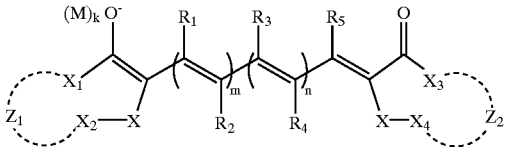

wherein $R_1$, $R_2$, $R_3$, $R_4$, and $R_5$ are independently hydrogen or an alkyl, aryl, cycloalkyl, non-aromatic heterocyclyl, halo, $R_6O$—, $R_7S(O)_t$—, $R_8$—(C=O)—, $R_9O$—(C=O)—, nitro, cyano, $R_{10}R_{11}N$—(C=O)—, $R_{12}R_{13}N$—$SO_2$—, or $R_{14}R_{15}N$— group, or any of $R_1$ and $R_2$, $R_2$ and $R_3$, $R_3$ and $R_4$, or $R_4$ and $R_5$, or any of $R_1$ and $R_3$, $R_2$ and $R_4$, or $R_3$ and $R_5$, can be taken together to form a 5- or 6-membered carbocyclic or heterocyclic ring, or $R_1$, $R_3$, and $R_5$ can be taken together to form 5- or 6-membered fused rings, $R_6$, $R_7$, $R_8$, $R_9$, $R_{10}$, $R_{11}$, $R_{12}$, $R_{13}$, $R_{14}$, and $R_{15}$ are independently hydrogen or an alkyl, cycloalkyl, aryl, or non-aromatic heterocyclyl group, M represents a counterion, k is the number of M counterions necessary to provide neutral charge for Structure II, X is a C=O, C=O, S, SO, $SO_2$, or $C{=}C(CN)_2$ group, $X_1$, $X_2$, $X_3$, and $X_4$ are independently C, N, O, or S atoms, and $Z_1$ and $Z_2$ independently represent a covalent bond between $X_1$ and $X_2$, or $X_3$ and $X_4$, or the non-metallic atoms necessary to complete a substituted or unsubstituted 6- or 7-membered carbocylic or heterocyclic ring with $X_1$ and $X_2$ or $X_3$ and $X_4$, m and n are independently 0, 1, or 2 provided that both are not 0, and t is 0, 1, or 2, or

III

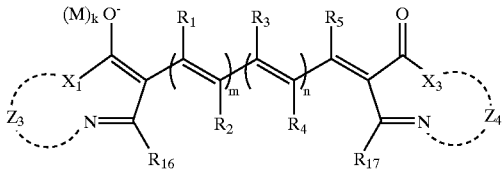

wherein $R_1$, $R_2$, $R_3$, $R_4$, and $R_5$ are independently hydrogen or an alkyl, aryl, cycloalkyl, non-aromatic heterocyclyl, halo, $R_6O$—, $R_7S(O)t$—, $R_8$—(C=O)—, $R_9O$—(C=O)—, nitro, cyano, $R_{10}R_{11}N$—(C=O)—, $R_{12}R_{13}N$—$SO_2$—, or $R_{14}R_{15}N$— group, or any of $R_1$ and $R_2$, $R_2$ and $R_3$, $R_3$ and $R_4$, or $R_4$ and $R_5$, or any of $R_1$ and $R_3$, or $R_2$ and $R_4$, or $R_3$ and $R_5$, can be taken together to form a 5- or 6-membered carbocyclic or heterocyclic ring, or $R_1$, $R_3$, and $R_5$ can be taken together to form 5- or 6-membered fused rings, $R_6$, $R_7$, $R_8$, $R_9$, $R_{10}$, $R_{11}$, $R_{12}$, $R_{13}$, $R_{14}$, and $R_{15}$ are independently hydrogen or an alkyl, cycloalkyl, aryl or heterocyclyl group, M represents a counterion, k is the number of M counterions necessary to provide neutral charge for Structure III, m and n are independently 0, 1, or 2 provided that both are not 0, t is 0, 1, or 2, $X_1$, and $X_3$ are independently C, N, O, or S atoms, and $Z_3$ and $Z_4$ independently represent a covalent bond between $X_1$ and its associated nitrogen atom, or $X_3$ and its associated nitrogen atom, or the non-metallic atoms necessary to provide a 6- or 7-membered ring with $X_1$ and its associated nitrogen atom, or $X_2$ and its associated nitrogen atom, and $R_{16}$ and $R_{17}$ are independently hydrogen or an alkyl, aryl, cycloalkyl, alkoxy, aryloxy, non-aromatic heterocyclyl, or carboxyalkyl group.

This invention also provides a black-and-white photothermographic material that is sensitive at a wavelength greater than 400 nm and comprises a support having thereon one or more thermally-developable imaging layers comprising a hydrophobic binder and in reactive association, a photocatalyst (such as a photosensitive silver halide), a non-photosensitive source of reducible silver ions, and a reducing composition for the non-photosensitive source of reducible silver ions, and on the backside of the support, an antihalation layer comprising the heat-bleachable antihalation composition described above.

Further, this invention provides a method of forming a visible image comprising:

A) imagewise exposing the black-and-white photothermographic material described above to electromagnetic radiation at a wavelength greater than 400 nm to form a latent image, and B) simultaneously or sequentially, heating the exposed photothermographic material to develop the latent image into a visible image.

In some embodiments, wherein the photothermographic material comprises a transparent support, the image-forming method further comprises:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

The present invention provides a number of advantages with the novel heat-bleachable antihalation composition described herein. The oxonol dyes used in the composition, combined with the hexaarylbiimidazoles, provide high initial visible light absorbance, and after thermal development, a particularly low level of residual coloration and a low absorption of radiation in the range of 360 to 400 nm. Overall, the oxonol dyes used in this invention also exhibit larger molar extinction coefficients than formazan dyes that are commonly suggested for antihalation compositions. This would mean that less oxonol dye may be needed to achieve the same optical density.

DETAILED DESCRIPTION OF THE INVENTION

The photothermographic materials of this invention can be used, for example, in conventional black-and-white photothermography, in electronically generated black-and-white hardcopy recording. They can be used in microfilm applications, in radiographic imaging (for example, digital medical imaging), and industrial radiography. Furthermore, the absorbance of these photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing. The photothermographic materials of this invention are particularly useful for medical radiography to provide black-and-white images.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photo-sensitive source of reducible silver ions are in catalytic proximity (or in reactive association with each other) and preferably are in the same layer.

Various layers are usually disposed on the "backside" (non-emulsion side) of the materials, including antihalation layer(s), protective layers, antistatic layers, conducting layers, and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

The present invention also provides a process for the formation of a visible image (usually a black-and-white image) by first exposing to electromagnetic radiation and thereafter heating the inventive photothermographic material. In one embodiment, the present invention provides a process comprising:

A) imagewise exposing the photothermographic material of this invention to electromagnetic radiation to which the photocatalyst (for example, a photosensitive silver halide) of the material is sensitive, to generate a latent image, and B) simultaneously or sequentially, heating the exposed material to develop the latent image into a visible image.

In some other embodiments wherein the photothermographic material comprises a transparent support, the image-forming method further comprises:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

This visible image can also be used as a mask for exposure of other photosensitive imageable materials, such as graphic arts films, proofing films, printing plates and circuit board films, that are sensitive to suitable imaging radiation (for example UV radiation). This can be done by imaging an imageable material (such as a photopolymer, a diazo material, a photoresist, or a photosensitive printing plate) through the exposed and heat-developed photothermographic material of this invention using steps C) and D) noted above.

When the photothermographic materials of this invention are heat-developed as described below in a substantially water-free condition after, or simultaneously with, imagewise exposure, a silver image (preferably a black-and-white silver image) is obtained. The photothermographic material may be exposed in step A using ultraviolet, visible, infrared or laser radiation using an infrared laser, a laser diode, an infrared laser diode, a light-emitting screen, CRT tube, a light-emitting diode, or other light or radiation source readily apparent to one skilled in the art.

Definitions

As used herein:

In the descriptions of the photothermographic materials of the present invention, "a" or "an" component refers to "at least one" of that component. For example, the HABI compounds and oxonol dye compounds described herein for heat-bleaching can be used individually or in combination.

HABI means hexaarylbiimidazole compound.

"Alkylcarboxy" means —alkyl-(C=O)—OH.

"Carbonyloxy" means —(C=O)—O and includes carboxylic acids as well as carboxyalkyl and carboxyaryl esters.

"Carboxyalkyl" means —(C=O)—O-alkyl.

"Carboxamido" means —(C=O)—N—($R^aR^b$) where $R^a$ and $R^b$ are independently hydrogen, alkyl, or aryl groups.

"Covalent bond" means a single or double bond between two atoms.

The presence of certain electron withdrawing groups as substituents at a saturated carbon atom renders hydrogen atoms bonded to that carbon relatively acidic. Such compounds are referred to as "active methylene compounds" and that portion of the compounds is referred to as an "active methylene group." Electron withdrawing groups capable of increasing the acidity of such hydrogen atoms include, but are not limited to, nitro, carbonyl, sulfone, cyano, and phenyl. The use and reactivity of such groups is known to the organic chemist and is more fully described in H. O. House, *Modern Synthetic Reactions*, $2^{nd}$ Edition, Chapter 9, p. 492, W. A. Benjamin, Inc. Menlo Park, Calif.

The term "heat-bleachable" as used in reference to the antihalation compositions of this invention refers to only those antihalation compositions that comprise one or more oxonol dyes that individually satisfy the following "dye bleaching test" in the described environment:

A 1 molar equivalent of an oxonol dye and 3 molar equivalents of the HABI derived from H-1 (identified below) are applied from a suitable organic solvent or mixture thereof with a polyvinyl butyral binder present at from 95–99% of the solids, to a polyethylene terephthalate support, and dried to provide a layer having a thickness of about 4 mμ. There should be sufficient oxonol dye in the dried layer to provide a layer absorbance (at its $\lambda_{max}$) attributable to the oxonol dye(s) of at least 0.2. This dried layer is then heated at 120° C. for 20 seconds, and the optical density (absorbance) is again measured at the oxonol dye $\lambda_{max}$. Oxonol dyes whose optical densities decrease by at least 70% under these conditions are within the scope of the present invention. Those oxonol dyes whose optical densities decrease by less than 70% when used in this test are considered to be outside of the present invention.

Preferably at least 80%, and more preferably at least 90%, of the heat-bleachable antihalation composition is rendered colorless when subjected to the noted "dye bleaching test." It would be readily apparent to one skilled in the art that the varying embodiments within the scope of the present invention would have varying degrees of thermal bleachability and that this property can be readily optimized with routine experimentation using the teaching described herein.

It would also be understood by one skilled in the art that a given oxonol dye could meet this "dye bleaching test," but whose optical densities could decrease by less than 70% when used under different formulation and heating conditions.

Heating in a substantially water-free condition as used herein, means heating at a temperature of from about 50° to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer," "imaging layer," or "photothermographic emulsion layer" means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed" or "photographic speed," $D_{min}$, and $D_{max}$ have conventional definitions known in the imaging arts.

"Transparent" means capable of transmitting visible light or imaging radiation without appreciable scattering or absorption.

As is well understood in this art, for the hexaarylbiimidazole and oxonol compounds herein described, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure*, 1978, Item 17643.

The shape of the photosensitive silver halide grains used in the present invention is in no way limited. The silver halide grains may have any crystalline habit including, but not limited to, cubic, octahedral, rhombic, dodecahedral, orthorhombic, tetrahedral, other polyhedral, laminar, twinned, platelet, or tabular morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.) incorporated herein by reference. Iridium and/or copper doped core-shell and non-core-shell grains are described in U.S. Pat. No. 5,434,043 (Zou et al.) and U.S. Pat. No. 5,939,249 (Zou), incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, The *Theory of the Photographic Process*, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

In some instances, it may be helpful to prepare the photosensitive silver halide grains in the presence of a hydroxytetrazaindene (such as 4-hydroxy-6-methyl-1,3,3,3a,7-tetrazaindene) or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.), incorporated herein by reference.

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76, and 17216/75.

The one or more light-sensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

Chemical and Spectral Sensitizers

The photosensitive silver halides used in this invention may be employed without modification. However, they are preferably chemically and/or spectrally sensitized in a manner similar to that used to sensitize conventional wet-processed silver halide photographic materials or state-of-the-art heat-developable photothermographic materials.

Thus, the photosensitive silver halides may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in T. H. James, *The Theory of the Photographic Process*, Fourth Edition, Chapter 5, pp. 149–169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh), and U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915 371 (Lok et al.), all incorporated herein by reference.

One method of chemical sensitization is by oxidative decomposition of a spectral sensitizing dye in the presence of a photothermographic emulsion, as described in U.S. Pat. No. 5,891,615 (Winslow et al.), incorporated herein by reference.

Sulfur-containing chemical sensitizers useful in the present invention are well known in the art and described for example, in Sheppard et al., *J. Franklin Inst.*, 1923, 196, pp. 653 and 673, C. E. K. Mees and T. H. James, The *Theory of the Photographic Process*, $4^{th}$ Edition, 1977, pp. 152–3, Tani, T., *Photographic Sensitivity: Theory and Mechanisms*, Oxford University Press, NY, 1995, pp. 167–176, U.S. Pat. No. 5,891,615 (Winslow et al.), Zavlin et al., IS&T's $48^{th}$ Annual Conference Papers, May 7–11 1995 Washington D.C., pp. 156–6), U.S. Pat. No. 4,810,626 (Burgmaier et al.), U.S. Pat. No. 4,036,650 (Kobayashi et al.), U.S. Pat. No. 4,213,784 (Ikenoue et al.), and U.S. Pat. No. 4,207,108 (Hiller), all incorporated herein by reference.

Particularly useful sulfur-containing chemical sensitizers are tetrasubstituted thiourea compounds, preferably such thiourea compounds that are substituted with the same or different aliphatic substituents, and more preferably such thiourea compounds that are substituted with the same aliphatic substituent. Such useful thioureas are described for example in U.S. Pat. No. 5,843,632 (Eshelman et al.) and in U.S. Pat. No. 6,368,779 (Lynch et al.), incorporated herein by reference.

Particularly, useful tellurium-containing chemical sensitizing compounds are described in copending and commonly assigned U.S. Ser. No. 09/746,400 (filed Dec. 21, 2000 by Lynch, Opatz, Shor, Simpson, Willett, and Gysling), incorporated herein by reference.

Useful combinations of sulfur- or tellurium-containing chemical sensitizers with gold(III) chemical sensitizers are described in copending and commonly assigned U.S. Ser. No. 09/768,094 (filed Jan. 23, 2001 by Simpson, Whitcomb, and Shor), incorporated herein by reference.

The total amount of chemical sensitizers that may be used during formulation of the imaging composition will generally vary depending upon the average size of silver halide grains. The total amount is generally at least $10^{-10}$ mole per mole of total silver, and preferably from $10^{-8}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary would be readily determinable by one of ordinary skill in the art.

In general, it may also be desirable to add spectral sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.), all incorporated herein by reference, are effective in the practice of the invention.

An appropriate amount of spectral sensitizing dye added is generally about $10^{-10}$ to $10^{-1}$ mole, and preferably, about $10^{-7}$ to $10^{-2}$ mole per mole of silver halide.

To further control the properties of photothermographic materials, (for example, contrast, $D_{min}$, speed, or fog), it may be preferable to add one or more heteroaromatic mercapto compounds or heteroaromatic disulfide compounds as "supersensitizers." Examples include compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. Many of the above compounds are described in EP-A-0 559 228 (Philip Jr. et al.) as supersensitizers for infrared photothermographic materials.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

Non-Photosensitive Source of Reducible Silver Ions

The non-photosensitive source of reducible silver ions used in photothermographic materials of this invention can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferred examples of the silver salts of aromatic carboxylic acid and other carboxylic acid group-containing compounds include, but are not limited to, silver benzoates, a silver substituted-benzoate, such as silver 3,5-dihydroxy-benzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the α- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free carboxylic acid and analyzing for about 22% silver, can be used. For opaque photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Non-photosensitive sources of reducible silver ions can also be provided as core-shell silver salts such as those described in commonly assigned and copending U.S. Pat. No. 6,355,408 (Whitcomb et al.), incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in copending U.S. Ser. No. 09/812,597 (filed Mar. 20, 2001 by Whitcomb), incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

The photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.), incorporated herein by reference.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more high contrast co-developing agents and contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis (hydroxyphenyl)methanes, hindered phenols, and hindered naphthols each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX or PERMANAX WSO), 1,1'-bis(3,5-di-t-butyl-4-hydroxyphenyl)methane, 2,2'-bis (4-hydroxy-3-methylphenyl)propane, 4,4'-ethylidene-bis(2-t-butyl-6-methylphenol), 2,2'-isobutylidene-bis(4,6-dimethylphenol) (LOWINOX 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-i-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienyl-amidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy- 1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,606 (Lynch et al.), incorporated herein by reference. Examples of these compounds include, but are not limited to, 2,5-dioxocyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers are substituted acrylonitrile compounds that can be represented by the following structure:

$$H(R')C{=}C(R)CN$$

wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halo atom, cyano group, carboxy group, ester group and phenylsulfonyl group). R' is a halo group (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quaternary ring nitrogen atom (such as pyridyl, furyl, diazolyl, triazolyl, pyrrolyl, tetrazolyl, benzotriazolyl, benzopyrrolyl and quinolinyl groups). Further details of these compounds and their preparation can be found in U.S. Pat. No. 5,635,339 (Murray) and U.S. Pat. No. 5,545,515 (Murray et al.), both incorporated herein by reference.

Examples of such compounds include, but are not limited to, the compounds identified as HET-01 and HET-02 in U.S. Pat. No. 5,635,339 (noted above) and CN-01 through CN-13 in U.S. Pat. No. 5,654,515 (noted above). Particularly useful compounds of this type are (hydroxymethylene) cyanoacetates and their metal salts.

Various contrast enhancers can be used in some photothermographic materials with specific co-developers. Examples of useful contrast enhancers include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Other Addenda

The photothermographic materials can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

The photothermographic materials can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600,589 (Philip, Jr. et al.) and EP-A-0 600,586 (Philip, Jr. et al.), and tribromomethylketones as described, for example, in EP-A-0 600,587 (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic and thermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(amino-methyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference] are particularly useful toners.

Binders

The photocatalyst (such as photosensitive silver halide), the non-photosensitive source of reducible silver ions, the reducing agent composition, and any other additives used in the present invention are generally added to one or more binders that are either hydrophilic or hydrophobic. Thus, either aqueous or solvent-based formulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Examples of useful hydrophilic binders include, but are not limited to, gelatin and gelatin-like derivatives (hardened or unhardened), cellulosic materials such as hydroxymethyl cellulose, acrylamide/methacrylamide polymers, acrylic/methacrylic acid polymers polyvinyl pyrrolidones, polyvinyl alcohols, and polysaccharides (such as dextrans and starch ethers).

Hardeners for various binders may be present if desired. Useful hardeners are well known and include diisocyanate compounds as described for example in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials can be prepared using a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 18431. A method of making dimensionally stable polyester films is described in *Research Disclosure*, September, 1999, item 42536.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) is preferably prepared by dissolving and/or dispersing a hydrophobic binder, the photothermographic emulsion (generally including the photosensitive silver halide and the non-photosensitive source of reducible silver ions), the reducing composition, and optional addenda in an organic solvent, such as toluene, 2-butanone (methyl ethyl ketone), acetone, or tetrahydrofuran. As noted above, these components can be distributed between two or more imaging layers. In some instances, some of the components can be formulated in a topcoat formulation and allowed to migrate into lower imaging layers.

Alternatively, these components can be formulated with a hydrophilic binder in water or water-organic solvent mixtures to provide aqueous-based coating formulations.

Photothermographic materials can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The photothermographic materials can include antistatic or conducting layers. Such layers may contain soluble salts (for example chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in copending and commonly assigned U.S. Ser. No. 09/510,648 (filed Feb. 23, 2000 by Ludemann, LaBelle, Geisler, Warren, Crump, and Bhave).

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers. An antihalation layer is essential to the present invention and is composed of a heat-bleachable composition of the present invention as described herein.

To promote image sharpness, photothermographic materials can contain one or more frontside layers containing acutance dyes. These dyes are chosen to have absorption close to the exposure wavelength and are designed to absorb scattered light. In addition, one or more antihalation dyes may be incorporated into one or more antihalation layers according to known techniques as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques.

Dyes useful as acutance dyes include dihydroperimidine squaraine dyes having the nucleus represented by the following general Structure:

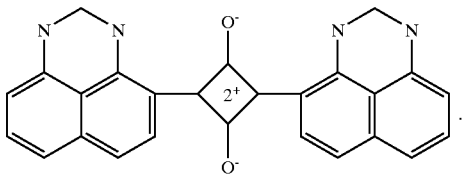

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Heat-Bleachable Antihalation Compositions

The advantages of the present invention are provided by use of particular heat-bleachable antihalation compositions in one or more antihalation layers of the photothermographic material. These compositions are preferably located on the backside of the photothermographic materials of this invention. Additionally or alternatively, one or more of these compositions may be incorporated into one or more frontside layers such as the photothermographic emulsion layer, primer layer, underlayer, or topcoat layer according to known techniques. Barrier layers separating these layers from the photothermographic emulsion layer are also envisioned. The use of these heat-bleachable antihalation compositions may be in addition to the use of other acutance and antihalation dyes described herein.

These compositions are heat-bleachable when subjected to the "dye bleaching test" described above. However, under practical conditions of use, the compositions are heated to provide bleaching at a temperature of at least 90° C. for at least 0.5 seconds. Preferably, bleaching is carried out at a temperature of from about 100 to about 200° C. for from about 5 to about 20 seconds. Most preferred bleaching is carried out within 20 seconds at a temperature of from about 110 to about 130° C.

Besides meeting the "dye bleaching test" described above, the essential one or more oxonol dyes useful in the practice of this invention are defined by the Structure I defined below. More preferred oxonol dyes are defined by the Structures I-A, I-B, I-C, II, and III defined below. Generally, each of those dyes has a $\lambda_{max}$ of at least 400 nm. Preferably, these compounds absorb at a wavelength within the range of from about 480 to about 850 nm, and preferably at from about 550 to about 700 nm. Most preferably, the $\lambda_{max}$ of the oxonol dye is substantially the same as the wavelength of the light used to expose the photosensitive layer.

The useful oxonol dyes can be represented by the following Structure I:

$$A_1{=}L_1{-}(L_2{=}L_3)_p{-}(L_4{=}L_5)_q{-}(L_6{=}L_7)_r{-}A_2^-(M)_k \qquad \text{I}$$

wherein $A_1$ and $A_2$ are the same or different activated methylene moieties, $L_1$ through $L_7$ independently represent a substituted or unsubstituted methine group, M represents a counterion, k is the number of M counterions necessary to provide a neutral charge for Structure I, p and q are independently 0 or 1, and r is 0, 1 or 2.

The methine groups represented by $L_1$ through $L_7$ can be unsubstituted or substituted with one or more of the groups described for $R_1$ through $R_5$ noted below. In addition, substituents on $L^1$ and $L^2$, $L^2$ and $L^3$, $L^3$ and $L^4$, $L^4$ and $L^5$, $L^5$ and $L^6$, $L^6$ and $L^7$, $L^1$ and $L^3$, $L^2$ and $L^4$, $L^3$ and $L^5$, $L^4$ and $L^6$, and $L^5$ and $L^7$ may be joined to form rings, which are preferably 5- or 6-membered rings consisting preferably of carbon atoms. Similarly, $L^1$, $L^3$, and $L^5$, $L^2$, $L^4$, and $L^6$, or $L^3$, $L^5$, and $L^7$ may be joined to form fused rings that are also preferably 5- or 6-membered rings consisting of carbon atoms. Such rings may contain additional substituent groups (for example, methyl, methylthio, phenylthio, or diphenylamino).

In Structure I, preferably p is 1 and at least one of q and r is 1.

Preferred oxonol dyes useful in this invention can be represented by the following Structure I-A, I-B, or I-C:

I-A

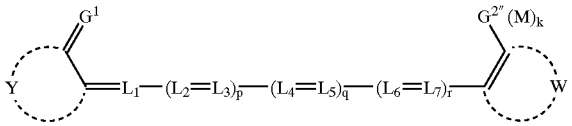

I-B

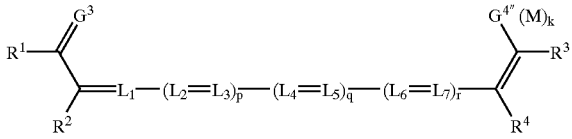

I-C

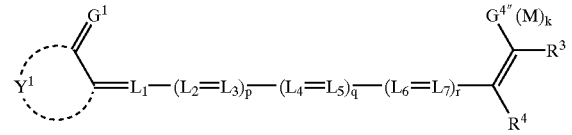

wherein W, Y, and $Y^1$ independently represent the non-metallic atoms necessary to form carbocyclic, or heterocyclic rings (such rings can also include fused ring systems having one or more fused rings attached to the primary ring), $R^1$ and $R^3$ are independently substituted or unsubstituted carbocyclic or heterocyclic aromatic groups (that is, carbocyclic and heterocyclic "aryl" groups, such as phenyl, naphthyl, xylyl, tolyl, pyridyl, 4-methoxyphenyl, pyrazyl, quinolyl, and thiophenyl groups). More preferably, W, Y, and $Y^1$ independently represent the non-metallic atoms necessary to form 5- to 7-membered carbocyclic or heterocyclic rings (such rings can also include fused ring systems as noted above), and $R^1$ and $R^3$ are independently phenyl or pyridyl groups.

$R^2$ and $R^4$ are independently electron-withdrawing groups. By "electron-withdrawing," we mean monovalent radicals that when positioned on a benzene ring, have a Hammett-sigma ($\sigma$) value of at least +0.3. Hammett-sigma values are standard values used to predict the electron withdrawing or electron donating effect of substituents on phenyl rings. Such values are known for many substituents [for example, see J. March, *Advanced Organic Chemistry: Reactions, Mechanisms, and Structure*, McGraw-Hill Book Company, New York, pp. 238–241, (1968) and C. Hansch et al., *Substituent Constants for Correlation Analysis in Chemistry*, John Wiley & Sons, New York, (1979)]. In addition, they can be calculated using standard procedures as described for example in M. S. Newman, *Steric Effects in Organic Chemistry*, John Wiley & Sons, Inc., pp. 570–574, 1956, and in *Progress in Physical Organic Chemistry*, vol. 2, Interscience Publishers, pp. 333–339, 1964.

Representative substituents that are sufficiently electron withdrawing groups for the present invention include, but are not limited to, keto, sulfone, sulfoxide, imino, carboxamide, nitro, nitroso, sulfo, sulfamoyl, cyano, carboxy, haloalkyl groups (such as trichloromethyl and trifluoromethyl), sulfoalkyl groups (such as sulfomethyl), carboxyalkyl groups (such as carboxymethyl), quaternary ammonium, (such as trimethylammonium), and halo groups (such as fluoro, chloro, and bromo). Other useful groups within this definition would be readily understood by one skilled in the art. The preferred electron withdrawing groups for $R^2$ and $R^4$ are cyano, carboxamido, sulfone, sulfonamido, benzoyl, and carbonyloxy (including carboxylic acids and carboxyalkyl and carboxyaryl esters) groups.

Further, in Structures I-A, I-B, and I-C, $G^1$, $G^2$, $G^3$, and $G^4$ are independently oxygen or a dicyanomethylene group,p is 1, and q and r are as defined above for Structure I. Preferably, $G^1$, $G^2$, $G^3$ and $G^4$ are oxygen, and at least one of r and q is 1.

Still more preferred oxonol dyes useful in the practice of this invention are those represented by the following Structures II and III:

II

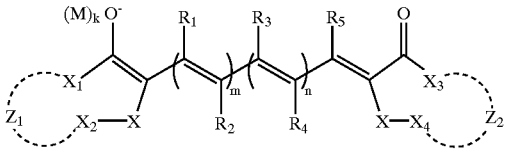

wherein $R_1$, $R_2$, $R_3$, $R_4$, and $R_5$ are independently hydrogen or a substituted or unsubstituted alkyl groups having 1 to 10 carbon atoms (such as methyl, ethyl, iso-propyl, t-butyl, n-hexyl, benzyl, methoxymethyl, and 2-ethoxyethyl), substituted or unsubstituted carbocyclic or heterocyclic aryl groups having 5 to 14 carbon and/or heteroatoms forming the aryl ring (such as phenyl, naphthyl, tolyl, p-methoxyphenyl, pyridyl, quinolinyl, furyl, pyrazyl, and pyrimidinyl), substituted or unsubstituted cycloalkyl groups having 5 to 10 carbon atoms forming the ring (such as cyclopentyl, cyclohexyl, p-methylcyclohexyl), substituted or unsubstituted non-aromatic heterocyclyl groups having 5 to 10 carbon, nitrogen, oxygen, and sulfur atoms forming the ring (such as tetrahydrofuranyl, piperdinyl, oxazolinyl, and dihydrothiophenyl), halo groups (such as fluoro, chloro, or bromo), $R_6O$—, $R_7S(O)_t$—, $R_8$—(C═O)—, $R_9$—(C═O)—, nitro, cyano, $R_{10}R_{11}N$—(C═O)—, $R_{12}R_{13}N$—$SO_2$—, or $R_{14}R_{15}N$— groups (primary, secondary, tertiary). Additionally, any of $R_1$ and $R_2$, $R_2$ and $R_3$, $R_3$ and $R_4$, or $R_4$ and $R_5$, or any of $R_1$ and $R_3$, $R_2$ $R_4$, or $R_3$ and $R_5$ can be taken together to form a 5- or 6-membered carbocyclic or heterocyclic ring, or $R_1$, $R_3$, and $R_5$ can be taken together to form 5- or 6-membered carbocyclic or heterocyclic fused rings (preferably such fused rings are 6-membered carbocyclic rings). Such rings (as defined by two or more of $R_1$ to $R_5$) may further contain substituent groups (for example, methyl, methylthio, phenylthio, or diphenylamino), or include one or more fused rings.

$R_6$, $R_7$, $R_8$, $R_9$, $R_{10}$, $R_{11}$, $R_{12}$, $R_{13}$, $R_{14}$, and $R_{15}$ are independently hydrogen or substituted or unsubstituted alkyl groups, substituted or unsubstituted cycloalkyl groups, substituted or unsubstituted carbocyclic or heterocyclic aryl groups, or substituted or unsubstituted non-aromatic heterocyclyl groups (all as defined above).

Moreover, X is C═O, C═O, S, SO, $SO_2$, or C═C$(CN)_2$, $X_1$, $X_2$, $X_3$, and $X_4$ are independently C, N, O, or S atoms, and M represents a counterion, and k is the number of M counterions necessary to provide a neutral charge for Structure II.

$Z_1$ and $Z_2$ independently represent a covalent bond (including single and double covalent bonds) between $X_1$ and $X_2$, or $X_3$ and $X_4$, or the non-metallic atoms and covalent bonds (including single and double covalent bonds) necessary to complete a substituted or unsubstituted 6- or 7-membered carbocylic or heterocyclic ring with $X_1$ and $X_2$ or $X_3$ and $X_4$. Thus, $Z_1$ and $Z_2$ can independently complete 5- to 7-membered carbocyclic or heterocyclic rings. Such carbocyclic and heterocyclic rings can be aromatic or non-aromatic in nature, and can include one or more fused carbocyclic, heterocyclic or aromatic rings containing carbon and/or various non-metallic heteroatoms to provide fused ring systems. All of these rings can be substituted with various substituents that would be readily apparent to one skilled in the art, including but not limited to, one or more alkyl groups, alkoxy groups, halo groups, carbocyclic or heterocyclic aryl groups, non-aromatic heterocyclyl groups, hydroxy groups, and oxo (═O) groups attached to carbon atoms to provide keto groups.

Carbon, nitrogen and sulfur are examples of preferred non-metallic atoms for Structure II. These additional non-metallic atoms may be further substituted such as, for example, with oxo (═O) on carbon to form a carbonyl (keto) group.

Also in Structure II, m and n are independently 0, 1, or 2 provided that both are not 0, and t is 0, 1, or 2.

More preferably for the compounds of Structure II, $R_1$, $R_2$, $R_3$, $R_4$, and $R_5$ are independently hydrogen or an alkyl or an aryl group, $R_8$—(C═O)—, or $R_{10}R_{11}N$—(C═O)— groups, or any of $R_1$ and $R_2$, $R_2$ and $R_3$, $R_3$ and $R_4$, or $R_4$ and $R_5$, or any of $R_1$ and $R_3$, $R_2$ and $R_4$, or $R_3$ and $R_5$, can be taken together to form a 5- or 6-membered carbocyclic or heterocyclic ring, or $R_1$, $R_3$, and $R_5$ can be taken together to form 5- or 6-membered carbocyclic or heterocyclic fused rings, $R_8$, $R_{10}$, and $R_{11}$ are independently hydrogen or an alkyl, cycloalkyl, or aryl group, m and n are independently 1 or 2, X is C═O $SO_2$, or C═C$(CN)_2$, $X_1$, $X_2$, $X_3$, and $X_4$ are independently C, N, or S atoms, and $Z_1$ and $Z_2$ independently represent the carbon atoms necessary to complete a 5- or 6-membered ring that can have one or more halo, alkyl, alkoxy, or oxo substituents and can have a fused ring of up to 10 atoms such as a furan, benzene or naphthalene ring.

Even more preferably, $R_1$, $R_2$, $R_3$, $R_4$, and $R_5$ are independently hydrogen or a methyl, ethyl, or $R_8$—(C═O)— group, $R_8$, $R_{10}$, and $R_{11}$ are independently are a methyl, ethyl, or cyclohexyl group, and each of m and n is 1.

Most preferably, $R_1$, $R_2$, $R_3$, $R_4$, and $R_5$ are independently hydrogen or a methyl or ethyl group, and at least one of m and n is 1, and the other is 1 or 2.

In some embodiments, the oxonol portion of the noted Structures is an anion, M is a cation ($M^+$), and k is the number of cations necessary to provide neutral charge for the compound. Representative non-limiting examples of cation $M^+$ are alkali metal ion, ammonium ion, alkylammonium ion, dialkylammonium ion, trialkylammonium ion, tetraalkylammonium ion, guanidinium ion, alkylguanidinium ion, phosphonium ion, and sulfonium ion. Often the oxonol dye has a (−1) charge, $M^+$ is triethylammonium, and k is 1.

Still again, useful oxonol dyes can be represented by the following Structure III:

III

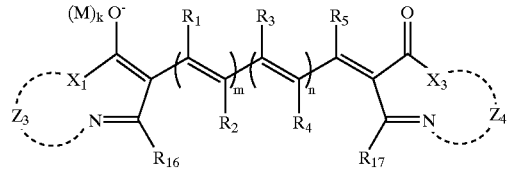

wherein $R_1$, $R_2$, $R_3$, $R_4$, $R_5$, M, k, m, n, $X_1$, and $X_3$ are as defined above, and $Z_3$ and $Z_4$ independently represent a covalent bond between $X_1$ and its associated nitrogen atom, or $X_3$ and its associated nitrogen atom, or the non-metallic atoms and covalent bonds (including single and double covalent bonds) necessary to provide a 6- or 7-membered heterocyclic ring with $X_1$ and its associated nitrogen atom, or $X_3$ and its associated nitrogen atom. Thus, $Z_3$ and $Z_4$ can independently complete 5- to 7-membered heterocyclic rings. Such heterocyclic rings can be aromatic or non-aromatic in nature, and can include one or more fused rings containing carbon and/or various non-metallic heteroatoms to provide fused ring systems of up to 10 atoms such as a furan, benzene or naphthalene ring. All of these rings can be substituted with various substituents that would be readily apparent to one skilled in the art, including but not limited to, one or more alkyl groups, alkoxy groups, halo groups, carbocyclic or heterocyclic aryl groups, non-aromatic heterocyclyl groups, hydroxy groups, and oxo (=O) groups attached to carbon atoms to provide keto groups.

$R_{16}$ and $R_{17}$ are independently hydrogen or a substituted or unsubstituted alkyl, substituted or unsubstituted aryl, substituted or unsubstituted cycloalkyl, or substituted or unsubstituted non-aromatic heterocyclyl group, all as defined above for Structure I. In addition, $R_{16}$ and $R_{17}$ are independently substituted or unsubstituted alkoxy groups having 1 to 10 carbon atoms (such as methoxy, 2-ethoxy, iso-propoxy, n-hexoxy, butoxy, methoxyethoxy, and phenylmethoxy), substituted or unsubstituted aryloxy groups having 6 to 10 carbon atoms forming the aryl ring (such as phenoxy, naphthoxy, and p-methyphenoxy), or substituted or unsubstituted carboxyalkyl groups having 1 to 10 carbon atoms in the alkyl portion of the groups (as defined above for "alkyl" groups).

More preferably, the compounds of Structure III are defined by $R_1$, $R_2$, $R_3$, $R_4$, and $R_5$, as being independently hydrogen or an alkyl, cycloalkyl, or carbocyclic or heterocyclic aryl group, $X_1$ and $X_3$ being independently C, N, or S atoms, m and n being independently 1 or 2, $Z_3$ and $Z_4$ independently representing a covalent bond between $X_1$ and the nitrogen atom, and $X_3$ and the nitrogen atom, and $R_{16}$ and $R_{17}$ being independently hydrogen or a carboxyalkyl group.

Carbon is a preferred non-metallic atom for Structure III. These additional non-metallic atoms may be further substituted such as, for example, with an oxo (=O) group to form a carbonyl (keto) group.

Even more preferably, $R_1$, $R_2$, $R_3$, $R_4$, and $R_5$, are independently hydrogen or a methyl or ethyl group, $X_1$ and $X_3$ are independently C or N atoms, m and n are each 1, and $R_{16}$ and $R_{17}$ are independently carboxyalkyl groups.

Representative oxonol compounds useful in the practice of this invention include, but are not limited to, the following Compounds O-1 to O-67.

O-1

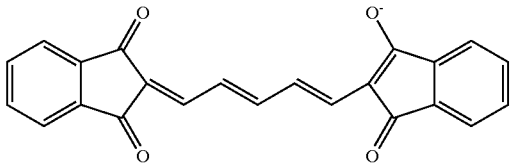

$(C_2H_5)_3NH^+$

O-2

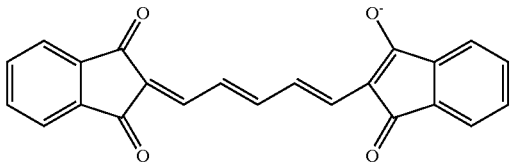

$K^+$

O-3

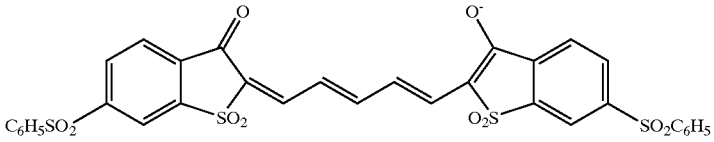

$(C_2H_5)_3NH^+$

O-4

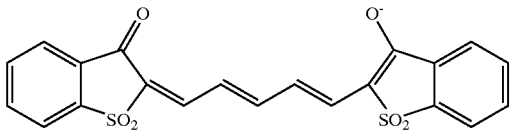

$K^+$

-continued
O-5
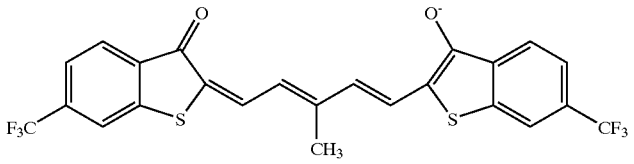
$(C_2H_5)_3NH^+$
O-6
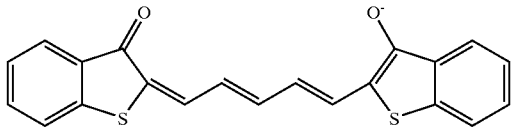
$(C_2H_5)_3NH^+$
O-7
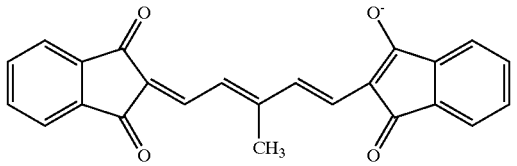
$(CH_3)_4N^+$
O-8
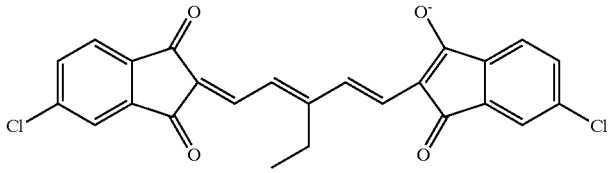
$Na^+$
O-9
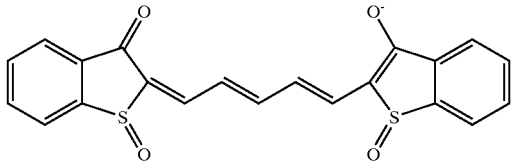
$(C_2H_5)_3NH^+$
O-10
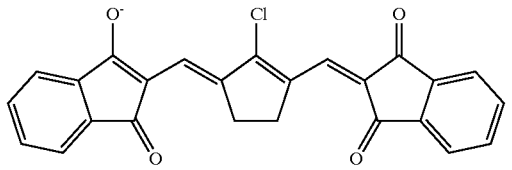
$(CH_3)_3NH^+$
O-11
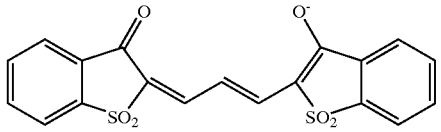
$(C_2H_5)_3NH^+$ -continued
O-12
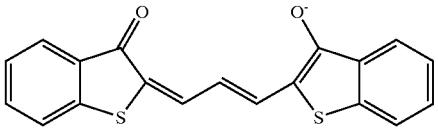
$(C_2H_5)_3NH^+$
O-13
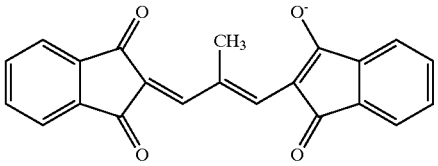
$(CH_3)_4N^+$
O-14
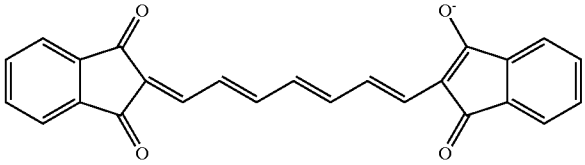
$Na^+$
O-15
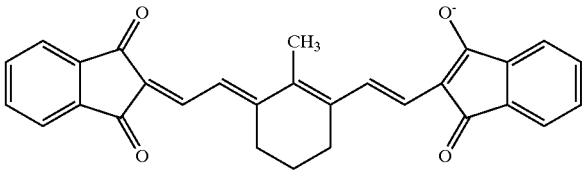
$(C_4H_9)_4N^+$
O-16
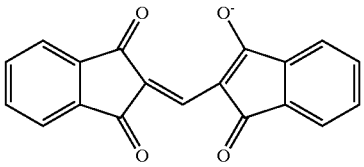
$(CH_3)_3NH^+$
O-17
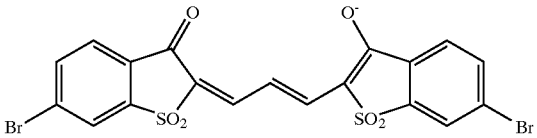
$(C_2H_5)_3NH^+$
O-18
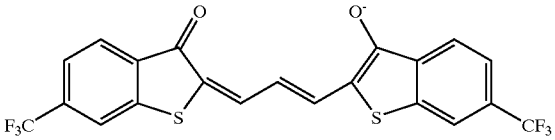
$(C_2H_5)_3NH^+$ -continued
O-19
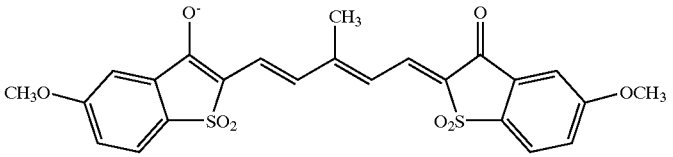
$(C_2H_5)_3NH^+$
O-20
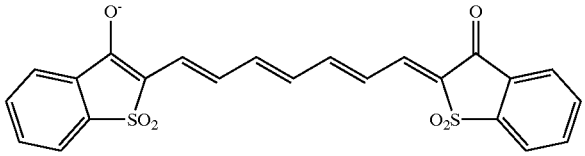
$(C_2H_5)_3NH^+$
O-21
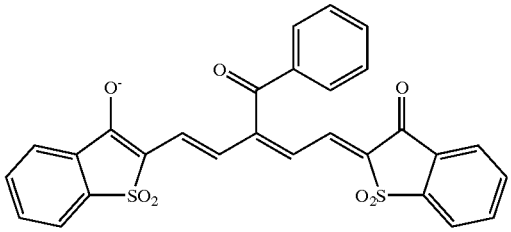
$(C_2H_5)_3NH^+$
O-22
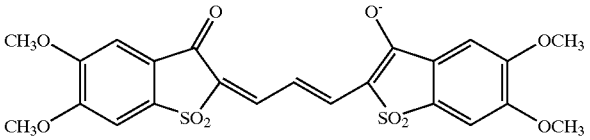
$(C_2H_5)_3NH^+$
O-23
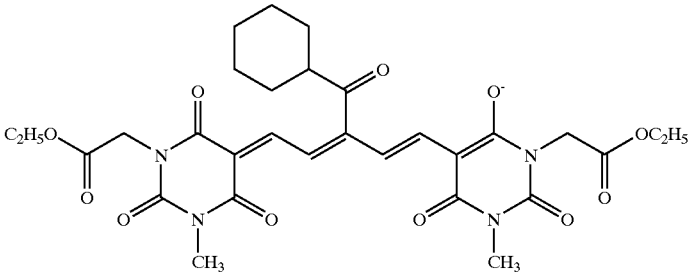
$(C_2H_5)_3NH^+$
O-24
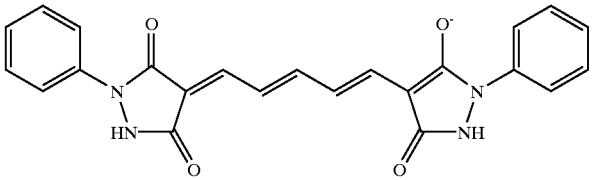
$(C_2H_5)_3NH^+$ -continued
O-25
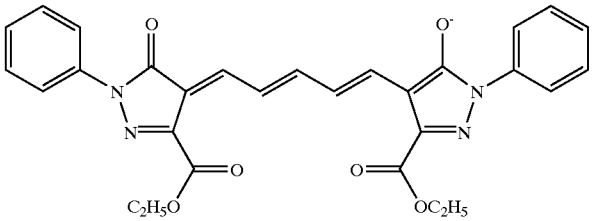
$(C_2H_5)_3NH^+$
O-26
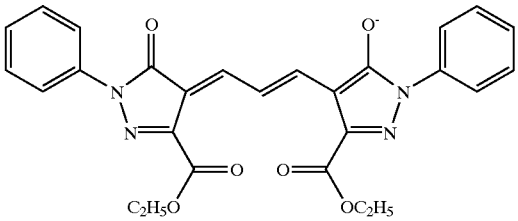
$(C_2H_5)_3NH^+$
O-27
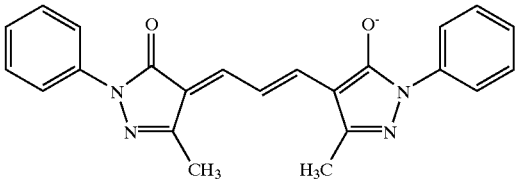
$(C_2H_5)_3NH^+$
O-28
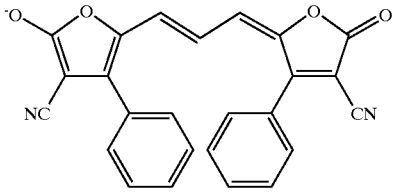
$(C_2H_5)_3NH^+$
O-29
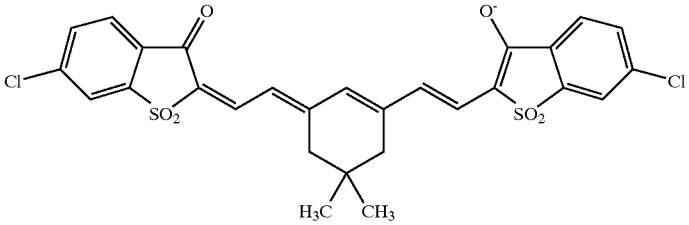
$(C_2H_5)_3NH^+$
O-30
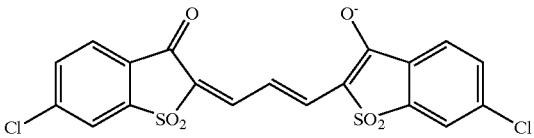
$(C_2H_5)_3NH^+$ -continued
O-31
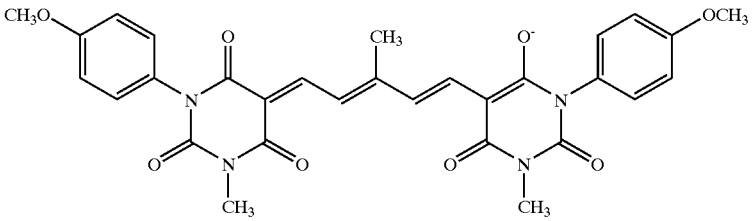
$(C_2H_5)_3NH^+$
O-32
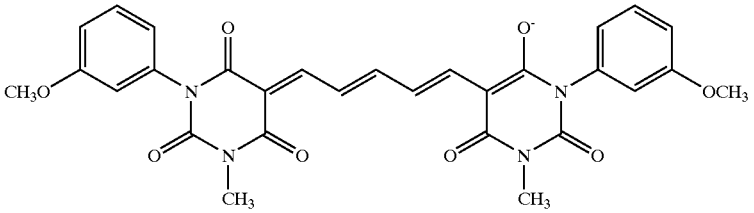
$(C_2H_5)_3NH^+$
O-33
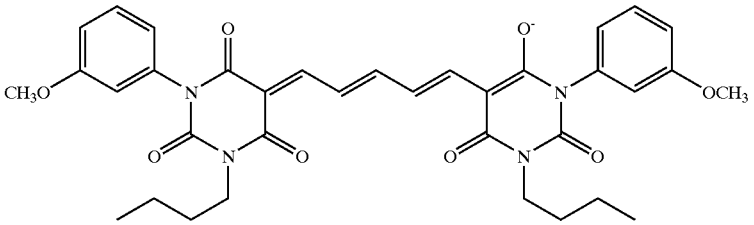
$(C_2H_5)_3NH^+$
O-34
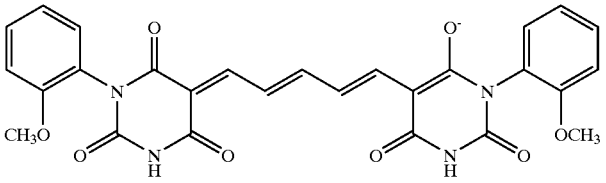
$(C_2H_5)_3NH^+$
O-35
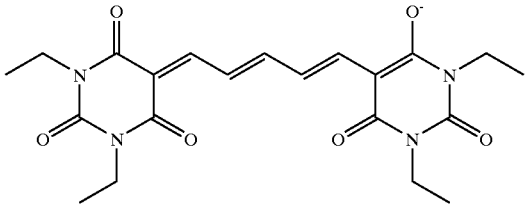
$(C_2H_5)_3NH^+$
O-36
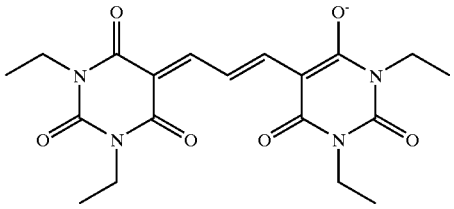
$(C_2H_5)_3NH^+$ -continued
O-37
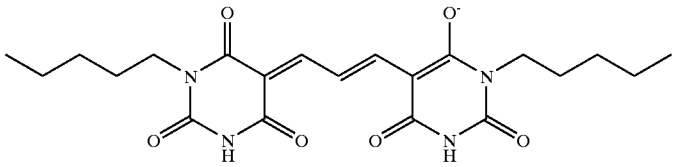
$(C_2H_5)_3NH^+$
O-38
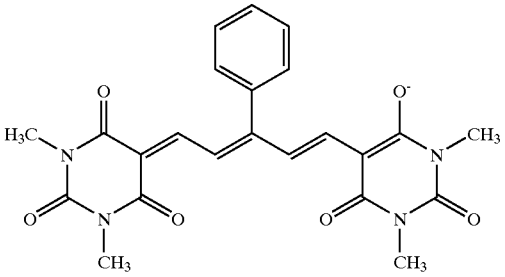
$Na^+$
O-39
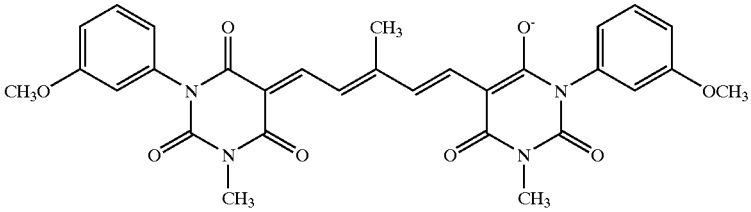
$(C_2H_5)_3NH^+$
O-40
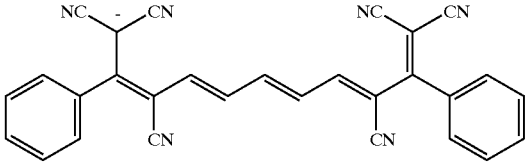
$(C_2H_5)_3NH^+$
O-41
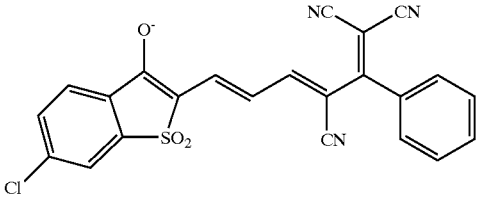
$(C_2H_5)_3NH^+$
O-42
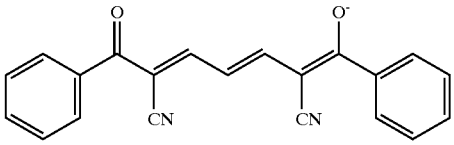
$(C_2H_5)_3NH^+$
O-43
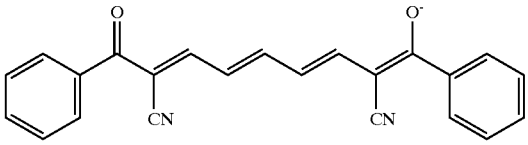
$(C_2H_5)_3NH^+$ -continued
O-44
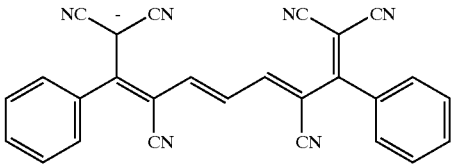
$(C_2H_5)_3NH^+$
O-45
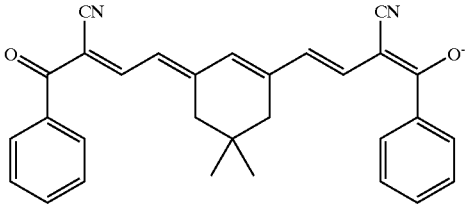
$(C_2H_5)_3NH^+$
O-46
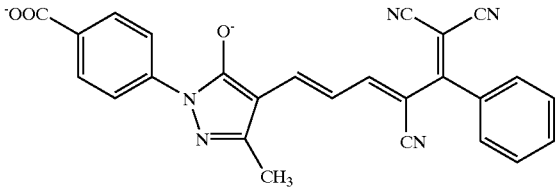
$[(C_2H_5)_3NH^+]_2$
O-47
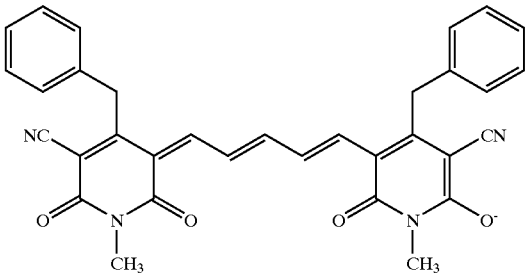
$Na^+$
O-48
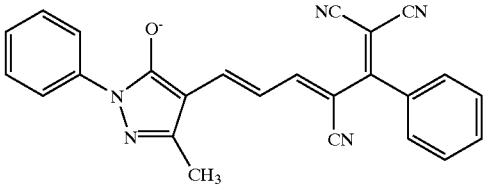
$(C_2H_5)_3NH^+$
O-49
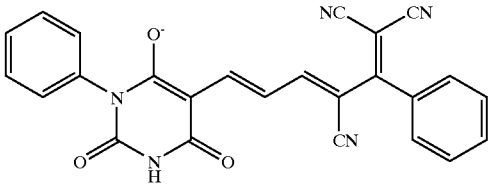
$(C_2H_5)_3NH^+$ -continued
O-50
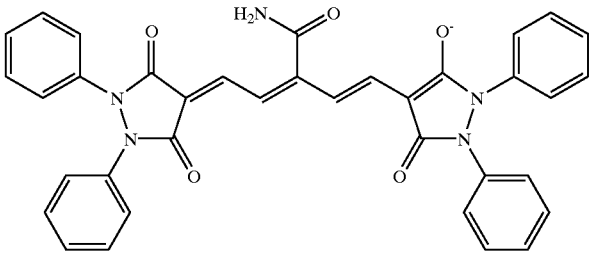
$Na^+$
O-51
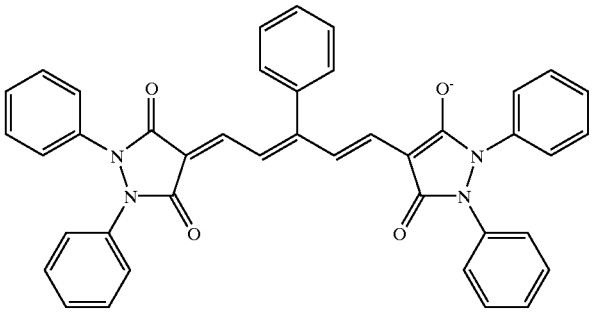
$Na^+$
O-52
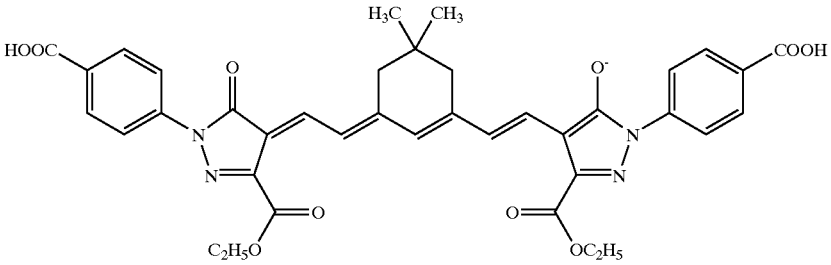
$(C_2H_5)_3NH^+$
O-53
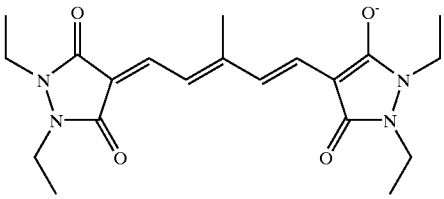
$(C_2H_5)_3NH^+$
O-54
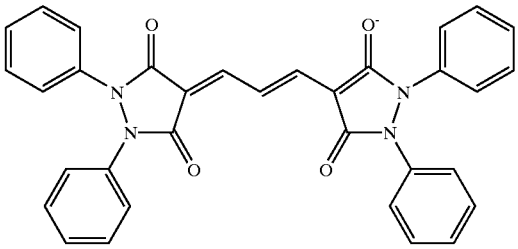
$(C_2H_5)_3NH^+$ -continued
O-55
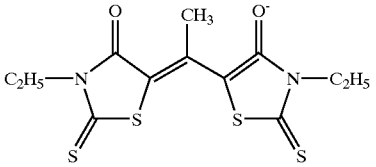
$(C_2H_5)_3NH^+$
O-56
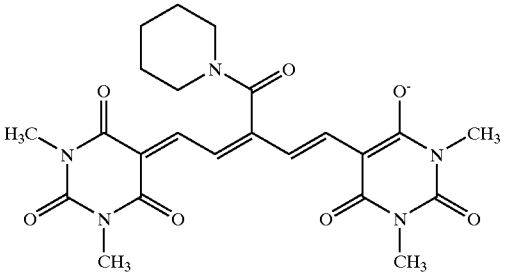
$(C_2H_5)_3NH^+$
O-57
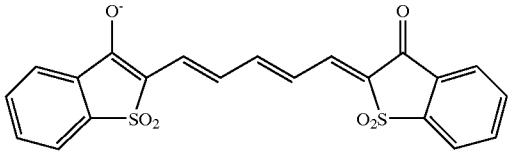
$(C_2H_5)_3NH^+$
O-58
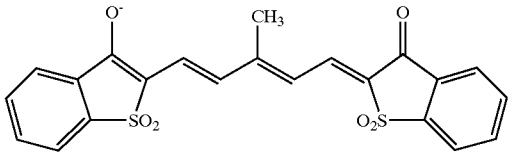
$(C_2H_5)_3NH^+$
O-59
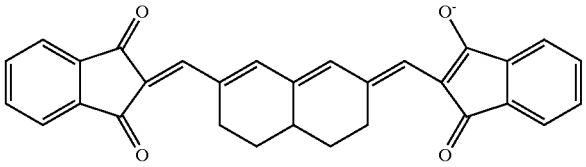
$Na^+$
O-60
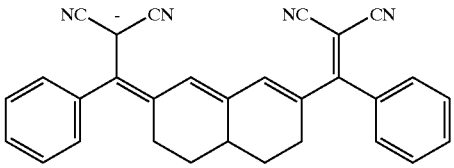
$(C_2H_5)_3NH^+$
O-61
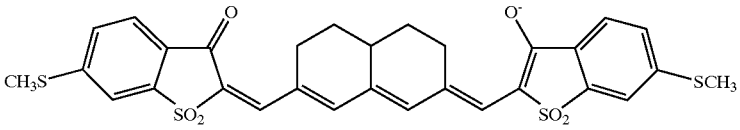
$(C_2H_5)_3NH^+$ -continued
O-62
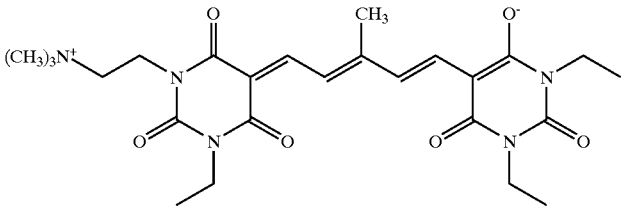
O-63
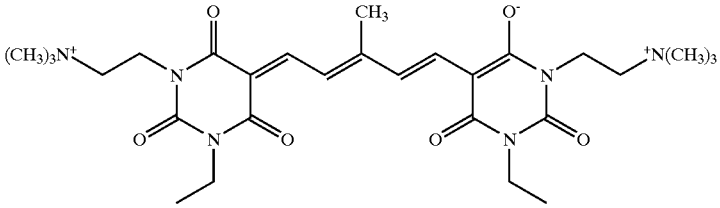
$BF_4^-$
O-64
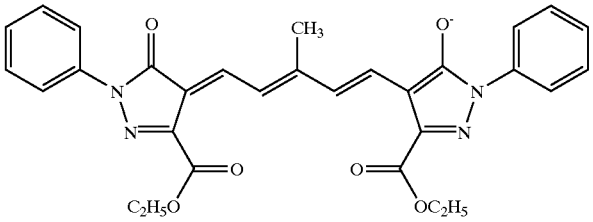
$(C_2H_5)_3NH^+$
O-65
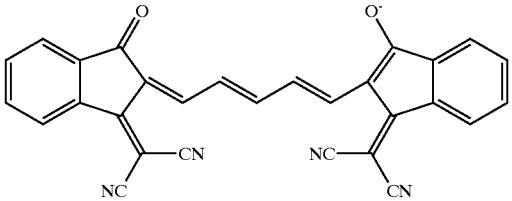
$(C_2H_5)_3NH^+$
O-66
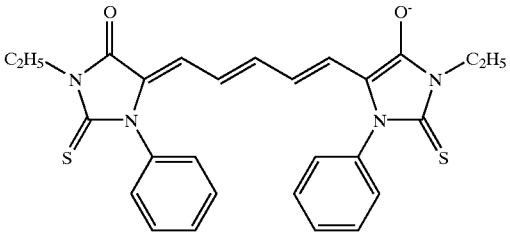
$(n\text{-}C_4H_9)_4N^+$
O-67
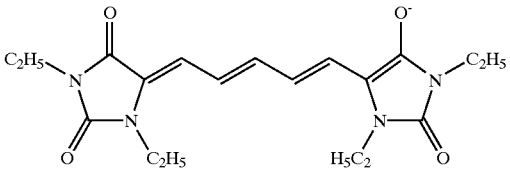
$(C_3H_7)_4N^+$ Mixtures of oxonol dyes can be used if desired, including mixtures of compounds represented by one of the structures noted above as well as mixtures of compounds represented by two or more of the noted structures.

The oxonol dyes can be prepared using known synthetic methods including those described by F. M. Hamer, *Cyanine Dyes and Related Compounds*, John Wiley & Sons, pp. 463–484, 1964.

The second essential component of the heat-bleachable antihalation composition of this invention is a hexaarylbiimidazole (also known as a "HABI"), or mixtures thereof. Such compounds are well known in the art, such as U.S. Pat. No. 4,196,002 (noted above), U.S. Pat. No. 5,652,091 (noted above), and U.S. Pat. No. 5,672,562 (noted above), all incorporated herein by reference. These compounds also known in the art as oxidative arylimidazolyl dimers including 2,4,5-triarylimidazolyl dimers comprising aryl groups that include p-isopropylphenyl, p-methoxyphenyl, p-n-butylphenyl, p-methylphenyl, and p-ethylphenyl.

Preferably, the hexaarylbiimidazole compounds are represented by the following Structure IV:

IV

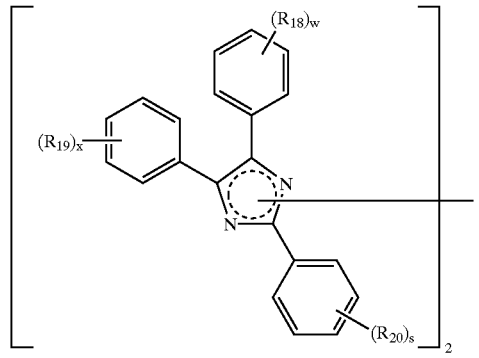

wherein $R_{18}$, $R_{19}$, and $R_{20}$ are independently hydrogen, substituted or unsubstituted alkyl groups having 1 to 10 carbon atoms (such as methyl, ethyl, iso-propyl, n-butyl, t-butyl, n-hexyl, hydroxymethyl, and benzyl) substituted or unsubstituted cycloalkyl groups having 5 to 10 carbon atoms forming the carbocyclic ring (such as cyclopentyl, cyclohexyl, p-methylcyclohexyl, and cycloheptyl), substituted or unsubstituted carbocyclic or heterocyclic aryl groups having 5 to 12 carbon and/or heteroatoms forming the ring (such as pyridyl, phenyl, tolyl, naphthyl, p-methoxyphenyl, o-carboxyphenyl, m-chlorophenyl, and furyl,), substituted or unsubstituted alkoxy groups having 1 to 10 carbon atoms (such as methoxy, 2-ethoxy, iso-propoxy, n-butoxy, methoxyethoxy, benzyloxy, and n-hexyloxy), substituted or unsubstituted aryloxy groups having 6 to 10 carbon atoms forming the ring (such as phenoxy, tolyloxy, naphthoxy, and p-chlorophenoxy), substituted or unsubstituted non-aromatic heterocyclyl groups (such as tetrahydrofuryl, tetrahydropyranyl, or piperidinyl), alkylthio, arylthio, cyano, sulfonamido, benzoyl, carbonyloxy (including carboxylic acids and carboxyalkyl and carboxyaryl esters), and carbonylamido groups, or halo groups (such as fluoro, chloro, or bromo groups), and w, x, and s are independently 0, 1, 2, 3, 4, or 5.

Preferably, each of $R_{18}$, $R_{19}$, and $R_{20}$ is in the meta orpara position on the respective phenyl rings. In addition, it is preferred that $R_{18}$, $R_{19}$, and $R_{20}$ are independently hydrogen, alkyl, alkoxy, cycloalkyl, aryl, aryloxy, non-aromatic heterocyclyl, alkylthio, arylthio, or halo groups, as defined above (both substituted and unsubstituted), and one or two of w, x, and s are independently 1 or 2.

More preferably, $R_{18}$, $R_{19}$, and $R_{20}$ are independently hydrogen, alkyl, alkoxy, or alkylthio groups as defined above (both substituted or unsubstituted). Most preferably, $R_{18}$, $R_{19}$, and $R_{20}$ are independently hydrogen, isopropyl, methoxy, or thiomethyl groups.

The HABI compounds can have a single chemical structure or they can exist as a mixture of isomers. A single triarylimidazole can conceivably give rise to different structural dimers if the dimer linkage is made via C—N, C—C, or N—N bonds. Thus, Structure IV is drawn to represent linkage via any of these bonds and the dashed circle represents the two double bonds within each triarylimidazole ring that can be located between any two adjacent atoms. These individual structural dimers or mixtures thereof can be generated chemically, thermally, or photolytically from a common triarylimidazole radical.

Representative hexaarylbiimidazole compounds useful in the practice of this invention include, but are not limited to, oxidative dimers formed from the following Compounds H-1 to H-27:

H-1

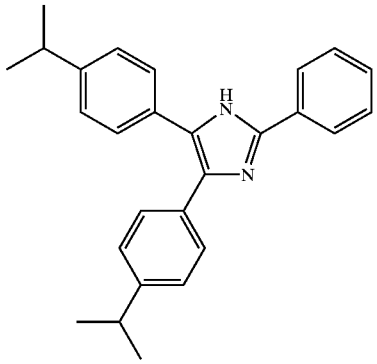

H-2

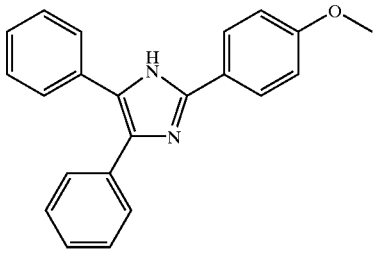

H-3

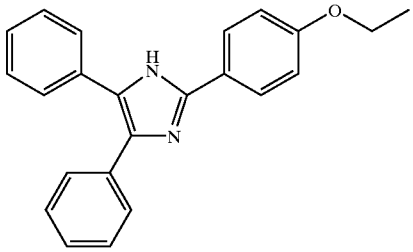

-continued
H-4
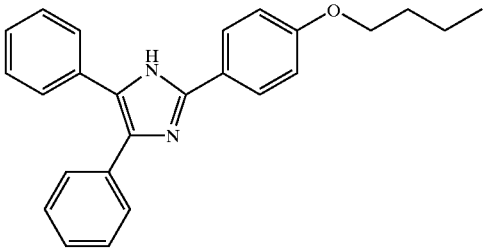
H-5
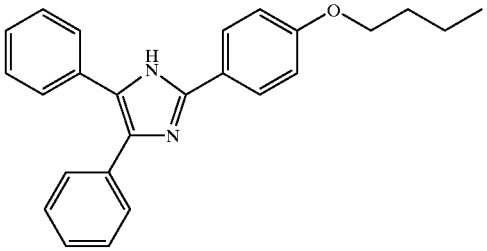
H-6
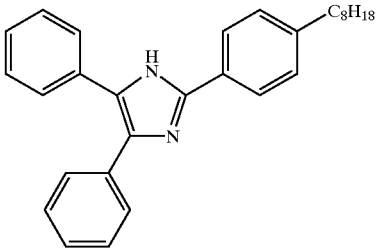
H-7
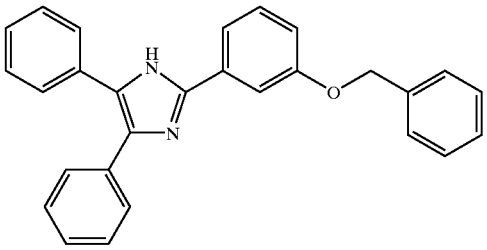
H-8
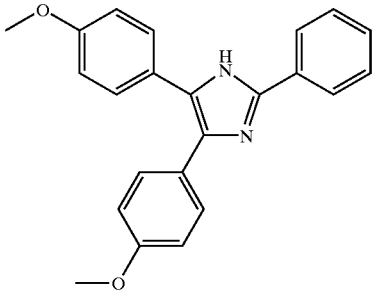
-continued
H-9
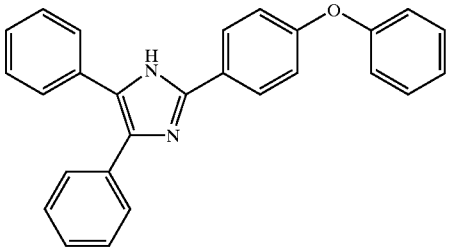
H-10
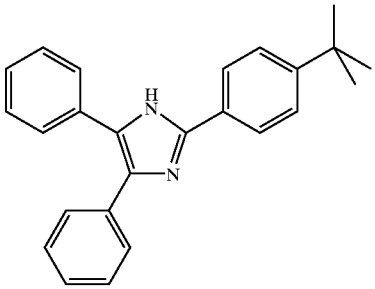
H-11
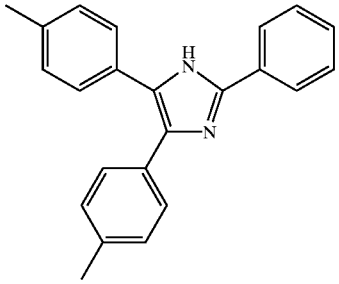
H-12
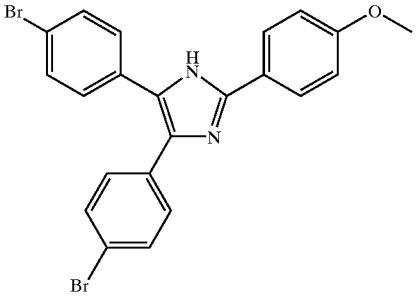
H-13
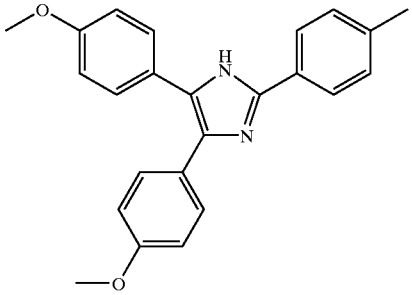

-continued
H-14
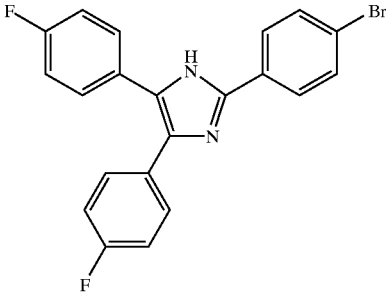
H-15
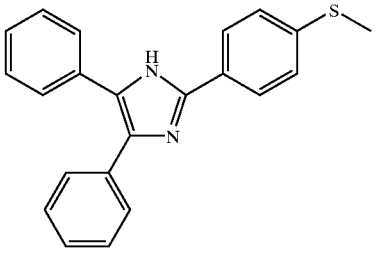
H-16
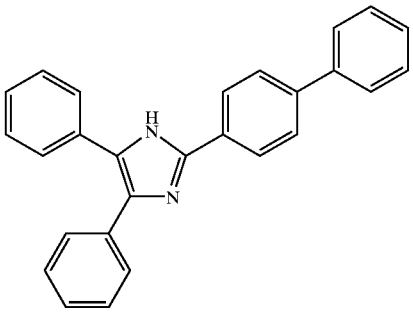
H-17
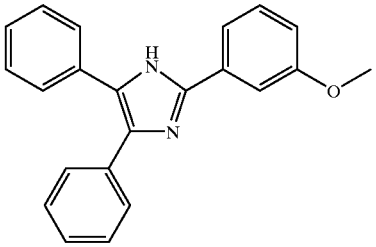
H-18
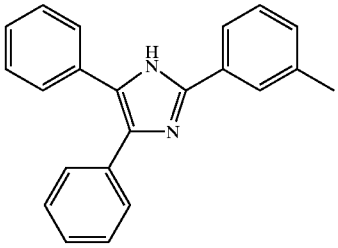
H-19
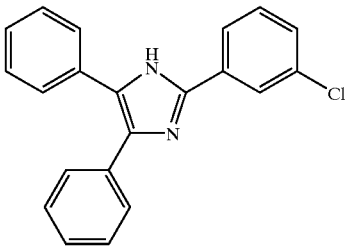
-continued
H-20
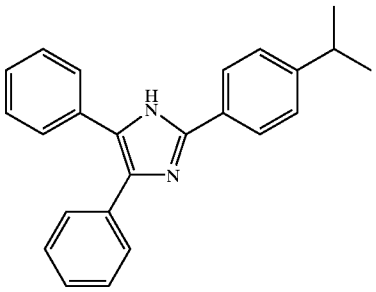
H-21
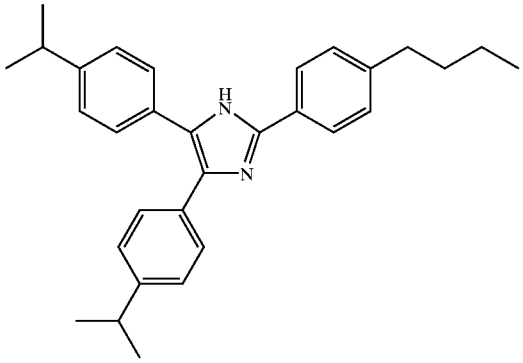
H-22
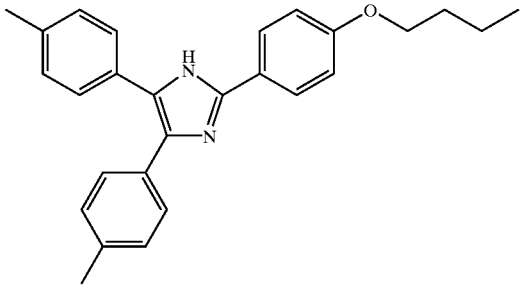
H-23
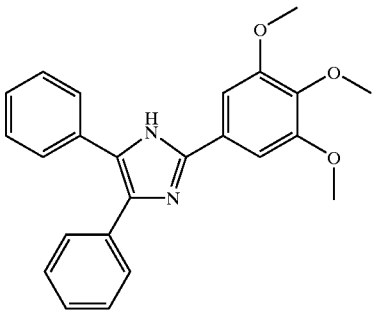
H-24
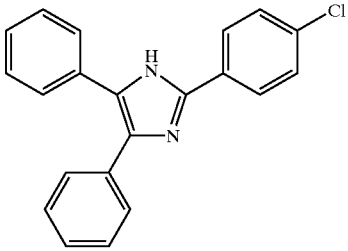

-continued

H-25

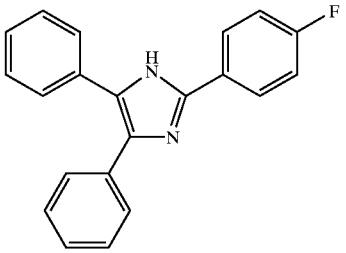

H-26

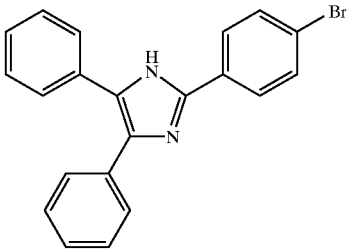

H-27

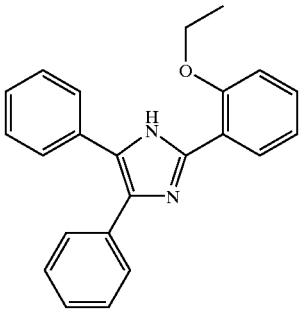

As noted above, HABI compounds can have a single chemical structure or they can exist as a mixture of isomers. For Compound H-1 typical non-limiting examples of its oxidative dimers include compounds H-1A, H-1B and H-1C shown below.

H-1A

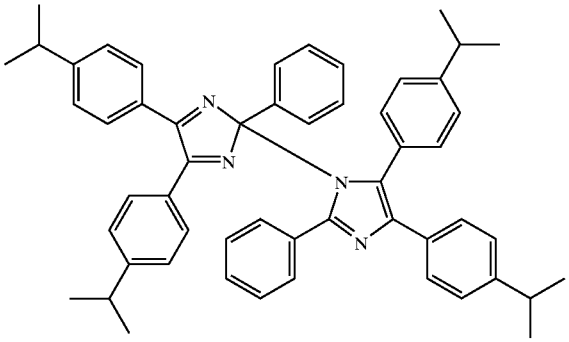

-continued

H-1B

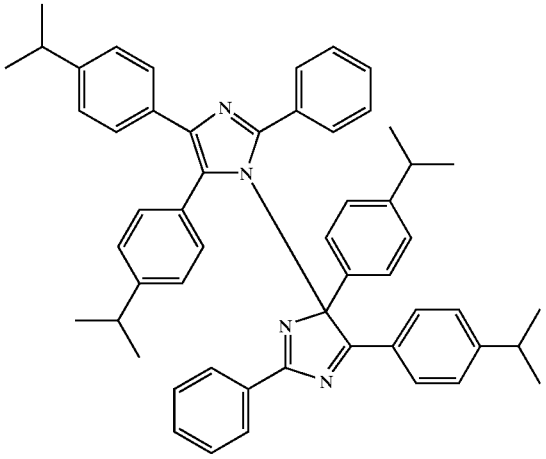

H-1C

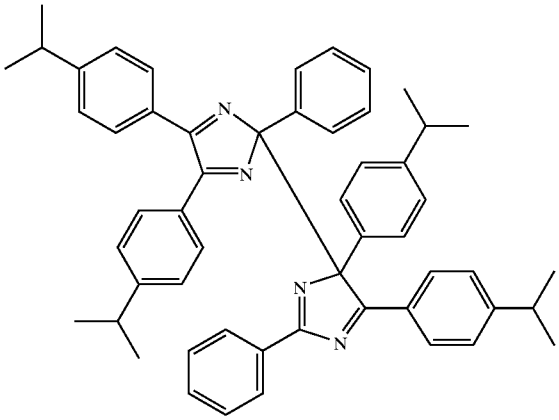

Further details of such compounds are provided by Tanino et al., *Bull. Chem. Soc. Jpn*, 1972,45, 1474–80, Lang et al., *J. Electroanal. Chem.* 1977, 78, 133–143, Baumgartel et al., *Z. Naturforsch.*, 1963, 18b, 406, and White et al., *J. Amer. Chem. Soc*, 1966, 88, 3825, as well as the Levinson et al., Perry et al., and Goswami et al. patents noted above.

The hexaarylbiimidazoles can be readily prepared using known preparatory methods that include interfacial oxidation of the parent triarylimidazole using potassium ferricyanide. Further details are provided, for example in U.S. Pat. No. 4,196,002 (noted above), U.S. Pat. No. 4,201,590 (noted above), Hayashi et al., *Bull. Chem. Soc. Jpn*, 1960, 33, 565, and U.S. Pat. No. 4,866,183 (Kempe et al.), all incorporated herein by reference.

One preferred antihalation composition comprises hexaarylbiimidazole compound H-1 and oxonol dye compound O-1 or O-25, or both.

The amount of one or more oxonol dyes present in the heat-bleachable antihalation compositions of this invention is generally at least 0.01, and preferably from about 0.1 to about 5 weight %, based on total dry formulation weight. The amount of one or more hexaarylbiimidazoles in the same composition is generally at least 0.05 and preferably from about 0.1 to about 10 weight %, based on total dry formulation weight.

In addition, the molar ratio of the one or more hexaarylbiimidazoles to the one or more oxonol dyes is generally from about 1:1 to about 100:1, and preferably from about 1:1 to about 4:1.

Based on conventional coating techniques and coverage, the resulting dry coated amount of oxonol dye is generally sufficient to provide an optical density of at least 0.1, and preferably an optical density of from about 0.3 to about 1.5. The dry coated amounts ($g/m^2$) will vary depending upon the absorptivity of the particular oxonol dyes but is generally at least $5\times10^{-7}$ $mol/m^2$. The amount of dry coated HABI is generally at least $5\times10^{-7}$ $mol/m^2$.

In most instances, the heat-bleachable antihalation compositions of this invention include one or more film-forming binders. These materials also must have a cumulative glass transition temperature of from about 30 to about 200° C. (preferably from about 50 to about 150° C.). Glass transition temperatures are well known parameters that can be measured using techniques and instruments known to polymer chemists.

Particularly useful binders include various homopolymers and copolymers that include, but are not limited to, polystyrenes (including polymers of styrene derivatives), polyacrylates, polymethacrylates, polycarbonates, cellulose esters, polyvinyl acetals, polysulfonamides, polyvinyl halides, polyvinylidene alides, polyvinyl acetate, butadiene polymer, polyesters, ethylene-vinyl acetate copolymers, polyvinyl alcohols, and gelatin. Particularly useful binders include polyvinyl butyral and cellulose esters. The binders generally comprise at least 70 weight % of the heat-bleachable antihalation composition, based on total formulation weight.

The methods of coating these heat-bleachable compositions are not critical. They may be coated by various coating procedures including wire wound rod coating, dip coating, air knife coating, curtain coating, slide coating, or extrusion coating. They may be coated from aqueous solutions, aqueous dispersions, organic solutions, or organic dispersions. When water soluble polymers are used, water and mixtures of water and organic solvents are preferred coating solvents.

It is preferable to coat these materials from organic solutions. These compositions generally include one or more organic solvents including, but not limited to, ketones (such as acetone, methyl isobutyl ketone, cyclohexanone, and methyl ethyl ketone), esters (such as ethyl acetate), lower alcohols (such as methanol, ethanol and isobutanol), chlorinated solvents (such as methylene chloride, trichloromethane, and tetrachloroethylene), N,N-dimethylformamide, toluene, tetrahydrofuran, dimethyl sulfoxide, acetonitrile, and mixtures thereof. Methyl ethyl ketone, acetone, methanol, ethanol, methyl isobutyl ketone, cyclohexanone, toluene, or mixtures thereof are preferred organic coating solvents.

The heat-bleachable antihalation compositions can also include a variety of other addenda generally used in antihalation layers of photothermographic materials including, but not limited to, non-heat-bleachable antihalation dyes, stabilizers (or stabilizer precursors), brighteners, antifoggants, hardeners, plasticizers, lubricants, antistatic agents (conductive agents), coating aids, surfactants, melt formers, colorants, particulates such as anti-slip agents and matte agents, and anti-fading agents.

Imaging/Development

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of from about 400 to about 850 nm.

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure*, September, 1996, item 38957 (such as sunlight, xenon lamps and fluorescent lamps). Particularly useful exposure means include laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using the materials of this invention, development conditions will vary, depending on the construction used but will typically involve heating the imagewise exposed material at a suitably elevated temperature. Thus, the latent image can be developed by heating the exposed material at a moderately elevated temperature of, for example, from about 50 to about 250° C. (preferably from about 80 to about 200° C. and more preferably from about 100 to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps.

Thermal development takes place at a higher temperature for a shorter time (for example at about 150° C. for up to 10 seconds), followed by thermal diffusion at a lower temperature (for example at about 80° C.) in the presence of a transfer solvent.

Use as a Photomask

The photothermographic materials described herein are sufficiently transmissive in the range of from about 350 to about 450 nm in non-imaged areas to allow their use in a process where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This process is particularly useful where the imageable medium comprises a printing plate and the photothermographic material serves as an imagesetting film.

The following examples are provided to illustrate the practice of this invention, and are not intended to be limiting in any manner. The examples provide exemplary synthetic procedures and preparatory procedures using the combination of chemical sensitizing compounds within the scope of the present invention.

Materials and Methods for the Examples:

All materials used in the following examples are readily available from standard commercial sources, such as Aldrich Chemical Co. (Milwaukee Wisconsin) unless otherwise specified. All percentages are by weight unless otherwise indicated. The following additional terms and materials were used.

ACRYLOID™ A-21 is an acrylic copolymer available from Rohm and Haas (Philadelphia, Pa.).

BUTVAR® B-79 and BUTVAR® B-76 are polyvinyl butyral resins available from Solutia, Inc. (St. Louis, Mo.).

CAB 171–15S is a cellulose acetate butyrate resin available from Eastman Chemical Co (Kingsport, Tenn.).

DESMODUR® N3300 is an aliphatic hexamethylene diisocyanate available from Bayer Chemicals (Pittsburgh, Pa.).

L-9342 is a perfluorinated organic antistatic agent described in U.S. Pat. No. 4,975,363 (Cavallo et al.).

PERMANAX WSO (or NONOX) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

MEK is methyl ethyl ketone (or 2-butanone).

"2-MBO" is 2-mercaptobenzoxazole (Aldrich Chemical Co.)

"PHP" is pyridinium hydrobromide perbromide.

Vitel 2200 is a polyester resin (Bostik, Inc., Middleton, Mass.).

GASIL 23F is a synthetic amorphous silicon dioxide (Crosfield Chemicals, Joliet Ill.).

SLIP-AYD SL 530 is an anti-slip agent available from Elementis Specialties Performance Additives (Hightstown, N.J.).

SMA-8 Beads are 8 μm polymeric styryl methacrylate hexanediol diacrylate beads available from 3M Company, (St. Paul, Minn.).

Sensitizing Dye A is

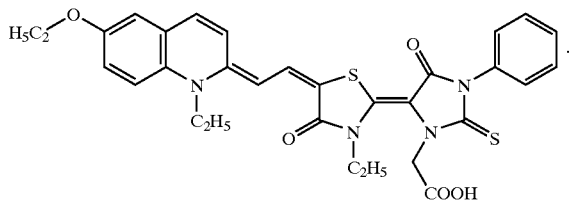

Compound HC-1 is described in U.S. Pat. No. 5,545,515 (noted above) and has the following structure:

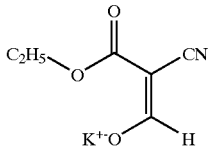

Vinyl Sulfone-1 (VS-1) is described in U.S. Pat. No. 6,143,487 and has the following structure:

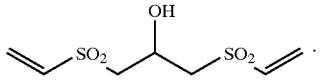

Antifoggant A is 2-(tribromomethylsulfonyl)quinoline and has the following structure:

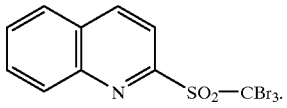

In the following examples, unless otherwise noted, all percentages are given by weight. Ortho Dmin and UV Dmin were measured by on an X-Rite Densitometer (X-Rite, Grandville, Minn.). Absorbance was measured on a conventional visible spectrophotometer at the given wavelength in optical density units. Color scale L, a*, and b* values were measured using the conventional CIE Commission Internationale de l'Eclairage) lab color scale. The a* value is a easure of redness (positive a*), and the b* value is a measure of yellowness positive b*). The "L" value represents the degree of darkness (an L of 100 is totally non-absorbing and an L of 0 is totally absorbing).

The following examples are provided to illustrate the practice of the present invention and the invention is not meant to be limited thereby.

EXAMPLES 1–8

Preparation of Antihalation Compositions

Coating formulations were prepared by mixing the components listed in TABLE I below. Each formulation was coated onto 4 mil (102 μm) thick poly(ethylene terephthalate) film support and dried at 71° C. for 60 seconds to provide a dry film coating coverage of 400 mg/ft$^2$ (5.4 g/m$^2$). The initial absorbance ("initial A") of the coated films was measured at the wavelength of maximal absorbance ($\lambda_{max}$)

The film was then thermally processed using a DRYVIEW Model 2771 Processor. Development was carried out at 120° C. for 20 seconds. The residual absorbance at $\lambda_{max}$ ("After Abs") was recorded, along with the visible optical density (ortho $D_{min}$), the ultraviolet absorbance in the 360 to 400 nm range (UV $D_{min}$), and the L, a*, and b* color values. These results are recorded in TABLE II below. The $\lambda_{max}$ for oxonol dye O-1 in the coating was 666 nm, and the $\lambda_{max}$ for oxonol dye O-25 in the coating was 668 nm.

The data below indicate that all of these examples have an initial absorbance of greater than 0.8 before bleaching. After processing, at least 88% of the dye is bleached. By adjusting the relative level of HABI, up to 98.3% (Examples 3, 4, 5) of Dye O-1, or up to 95.9% (Example 8) of Dye O-25 can be bleached. Thus, the bleached visible densities are low (0.031 and 0.056 respectively), the UV Dmin are low (less than 0.11), and the residual colors as measured by a*, and b* are low. If desired, the values of a* and b* can be adjusted by varying the level of HABI used. This allows any faint residual tint to usted to suit the intended use.

TABLE I

| Component\Example | 1 | 2 | 3 | 4 | 5 | 6 | 7 | 8 |
|---|---|---|---|---|---|---|---|---|
| MEK (g) | 6.36 | 6.37 | 6.37 | 6.38 | 6.39 | 5.95 | 5.97 | 5.99 |
| HABI derived from H-1 (mg) | 7 | 9 | 10 | 11 | 12 | 22 | 25 | 30 |
| Dye O-1 (g of 1% solution in MEK) | 0.46 | 0.46 | 0.46 | 0.46 | 0.46 | — | — | — |
| Dye O-25 (g of 1% solution in MEK) | — | — | — | — | — | 0.99 | 0.99 | 0.99 |
| BUTVAR ® B-79 (g of 15% solution in MEK) | 8.17 | 8.16 | 8.15 | 8.14 | 8.14 | 8.04 | 8.02 | 7.99 |
| HABI/DYE mole ratio | 0.913 | 1.17 | 1.30 | 1.43 | 1.56 | 1.84 | 2.09 | 2.51 |

TABLE II

| Example | Dye | Initial Abs | After Abs | Ortho $D_{min}$ | UV $D_{min}$ | L | a* | b* |
|---|---|---|---|---|---|---|---|---|
| 1 | O-1 | 0.81 | 0.043 | 0.038 | 0.082 | 93.77 | −1.63 | 0.75 |
| 2 | O-1 | 0.84 | 0.044 | 0.037 | 0.084 | 93.78 | −1.10 | 1.05 |
| 3 | O-1 | 0.84 | 0.014 | 0.038 | 0.084 | 94.11 | −0.76 | 1.22 |
| 4 | O-1 | 0.84 | 0.014 | 0.033 | 0.082 | 94.45 | −0.34 | 1.52 |
| 5 | O-1 | 0.84 | 0.014 | 0.031 | 0.082 | 94.54 | −0.25 | 1.60 |
| 6 | O-25 | 0.88 | 0.100 | 0.067 | 0.104 | 91.42 | −3.03 | 0.30 |
| 7 | O-25 | 0.88 | 0.063 | 0.061 | 0.101 | 92.22 | −1.25 | 1.24 |
| 8 | O-25 | 0.80 | 0.033 | 0.056 | 0.101 | 92.73 | −0.33 | 1.86 |

EXAMPLE 9

Preparation of Photothermographic Material

Antihalation Formulation:

An antihalation composition of this invention was prepared as follows:

To a solution of 65.14 parts of BUTVAR® B79 in 183.95 parts of MEK were added, in order:

| | |
|---|---|
| L-9342 Antistat | 6.12 parts of a 75% solids solution |
| Vitel 2200 | 5.34 parts |
| MEK | 8.10 parts |
| GASIL 23 F | 0.15 parts |
| SLIP-AYD SL 530 | 0.73 parts |
| MEK | 26.99 parts |
| Oxonol dye O-1 | 0.45 parts |
| MEK | 26.99 parts |
| HABI derived from H-1 | 1.03 parts |

This antihalation formulation was coated on the backside of a 4 mil (102 $\mu$m) polyethylene terephthalate support that had been previously coated with a photothermographic emulsion formulation and topcoat formulation prepared as follows.

Photothermographic Emulsion Formulation:

A preformed silver halide, silver carboxylate "soap" was prepared as described in U.S. Pat. No. 5,382,504 (noted above). The average silver halide grain size was 0.12 $\mu$m. The photothernographic emulsion was prepared from the soap dispersion in a manner similar to that described in U.S. Pat. No. 6,083,681 (noted above) but using the materials and amounts shown below.

To 189.3 parts of this silver soap dispersion at 26.5% solids were added, in order:

| | |
|---|---|
| MEK | 4.07 parts |
| Pyridinium hydrobromide perbromide | 0.26 parts in 0.77 parts methanol |
| Zinc bromide | 0.29 parts in 0.78 parts methanol |
| $Te[S=C(N(CH_3)_2)_2]_2Cl_4$ | 0.01 part in 3.56 parts methanol. |
| BUTVAR ® B-79 | 1.13 parts |
| Sensitizing Dye A premix formulation | 2.36 parts of 4-chlorobenzoyl benzoic acid, 0.014 parts of Sensitizing Dye A, and 0.014 parts of 2-methyl-benzoxazole, in 10.0 parts methanol |
| BUTVAR ® B-79 | 32.36 parts |
| Antifoggant A | 1.60 parts in 21.73 parts of MEK |
| DESMODUR ® N3300 | 0.50 parts in 0.99 parts MEK |
| Phthalazine | 1.22 parts in 5.75 parts MEK |
| Tetrachlorophthalic acid | 0.27 parts in 0.55 parts MEK and 0.55 parts methanol |
| 4-Methylphthalic acid | 0.61 parts in 0.48 parts methanol and 4.60 parts MEK |
| Compound HC-1 | 0.22 parts in 3.77 parts methanol |
| PERMANAX WSO | 12.20 parts |

Protective topcoat Formulation:

A protective topcoat for the photothermographic emulsion layer was prepared as follows:

| | |
|---|---|
| MEK | 113.93 parts |
| Methanol | 20.80 parts |
| ACRYLOID-21 | 0.95 parts |
| CAB 171-15S | 24.70 parts |
| Vinyl sulfone (VS-1) | 1.45 parts in 12.43 parts MEK |
| MEK | 15.74 parts |
| SMA-8 beads | 0.12 parts in 0.65 parts MEK |

The resulting photothermographic material was image-wise exposed to laser light at 670 nm through a 0–3 continuous density wedge at an exposure of 2.9 log E and heat-developed in a DRYVIEW 2771 processor at 120° C. for 20 seconds to provide an acceptable black-and-white image. Halation was not observed. Before processing, the absorbance at 670 nm was 0.867, and after processing, it was 0.057 (93% bleached). Thus, the backside antihalation layer was acceptably bleached during heat-development.

COMPARATIVE EXAMPLE 1 and 2

The following comparative examples used an Oxonol dye shown in U.S. Pat. No. 4,196,002 (noted above). This dye, designated Comparative Dye-1 (CD-1) has a $\lambda_{max}$ at 538 nm. It has the structure shown below.

Coating solutions were prepared by mixing the following components in the order shown in the following TABLE III:

TABLE III

| Material | Comparative Example 1 | Comparative Example 2 |
|---|---|---|
| Methanol | 3.34 g | 2.26 g |
| Triethylamine | 0.1 g | 0.1 g |
| Comparative Dye CD-1 | 0.032 g | 0.032 g |
| L-9342 Antistat | 0.11 g | 0.11 g |
| 25% BUTVAR ® B-79 in MEK | 4.29 g | 4.09 g |
| 4.0% HABI derived from H-1 in MEK | 2.231 g | 3.506 g |

The solutions were coated onto 4 mil (102 $\mu$m) polyethylene terephthalate film using a #60 wire-wound coating rod, and dried at 160° F. (71° C.) for 1 minute. The films were thermally processed and evaluated as described in Examples 1–8. The results are recorded in TABLE IV below.

TABLE IV

| Comparative Example | Dye | HABI/Dye mole ratio | Absorbance before Bleaching | Absorbance after Bleaching | % Bleached |
|---|---|---|---|---|---|
| 1 | CD-1 | 2.00 | 0.7488 | 0.3608 | 52% |
| 2 | CD-1 | 3.14 | 0.7363 | 0.2691 | 63% |

Comparative Dye CD-1 has the structure shown below:

CD-1

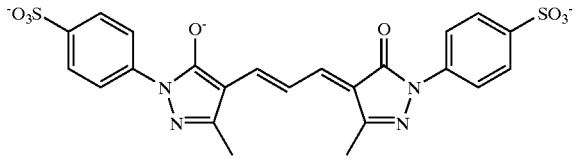

Even at the higher level of HABI (Comparative Example 2), in which more HABI was incorporated than required by the inventive test, only 63% of the dye was bleached.

EXAMPLE 10

A heat-bleachable composition of the present invention was prepared and compared to a heat-bleachable composition of the prior art. The prior art Control composition comprised zinc formazan dye F-1 (shown below, which is formazan F-3 of U.S. Pat. No. 5,672,562, noted above) and HABI dimer H-1. The composition of the present invention included oxonol dye O-1 and the same HABI dimer compound.

F-1

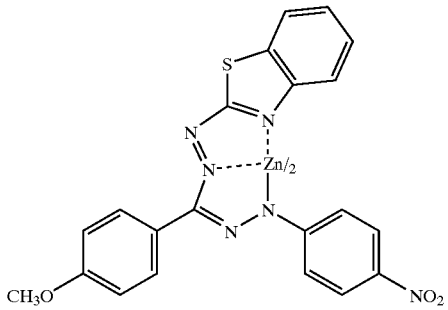

The antihalation composition formulations were prepared using the following components:

Control Composition: containing formazan dye F-1 (50 mg), HABI H-1 (125 mg), m-anisic acid (m-methoxybenzoic acid, 40 mg), BUTVAR® B-79 polyvinyl butyral (750 mg), and MEK (17 g).

Invention Composition: oxonol dye O-1 (24 mg), HABI H-1 (70 mg), BUTVAR® B-76 polyvinyl butyral (750 mg), and MEK (17 g).

Each formulation was coated on a 3 mil (76 $\mu$m) poly (ethylene terephthalate) support and dried overnight in a vacuum oven at room temperature. Each dried coating was subjected to the heat processing conditions (using a horseshoe shaped thermal block) shown in TABLE V below. Optical densities were measured before and after heat processing at various wavelengths using a conventional spectrophotometer.

The data, shown below in TABLE V demonstrates that the antihalation composition of the present invention provides more than twice the optical density at 670 nm while containing less than half the amount of oxonol dye as the formazan dye. More efficient bleaching was possible with the invention composition compared to the Control composition. Similar bleaching of the invention composition was achieved in half the time at 120° C. Moreover, much less residual density was observed at 360 nm after thermal bleaching of the Invention composition compared to the Control composition.

TABLE V

| Composition, Condition | Optical Density at 670 nm | Optical Density at 630 nm | Optical Density at 400 nm | Optical Density at 360 nm |
|---|---|---|---|---|
| Control, Fresh | 0.424 | 0.346 | 0.272 | 0.384 |
| Control, Processed at 120° C., 20 sec. | 0.017 | 0.013 | 0.083 | 0.360 |
| Invention, Fresh | 1.040 | 0.414 | 0.058 | 0.094 |
| Invention, Processed at 120° C., 10 sec. | 0.019 | 0.027 | 0.121 | 0.157 |

EXAMPLE 11–17

Antihalation Compositions with Various HABI Compounds

Seven additional heat-bleachable antihalation compositions of the present invention were prepared using the oxonol dye O-25 and different HABI compounds. These compositions were prepared, coating and evaluated as follows.

A solvent mixture of toluene, propanol, and cyclohexanone (volume ratio of 65:30:5) was used to prepare the coating formulations. A dye stock solution was prepared by dissolving oxonol Dye O-25 (861 mg) and BUTVAR® B-76 polyvinyl butyral (17.1 g) in 300 ml of the solvent mixture. A sample (17.5 g) of this dye stock solution and FLUORAD FC431 nonionic surfactant (3M Corp., 250 mg) were added to a solution of the solvent mixture (17.07 g) containing various HABI compounds 181 mg). The resulting coating formulation was stirred and coated immediately onto a 3 mil (76 $\mu$m) poly(ethylene terephthalate) film support (8.2 ml/ft$^2$ or 88.6 ml/m$^2$ wet coverage). The coatings were dried overnight in a vacuum oven at room temperature. The resulting coated heat-bleachable antihalation layers. were heat-processed using the same procedures described in Example 10. The optical densities at 670 nm were measured after processing.

The data for these seven coatings, given in TABLE VI below, demonstrate that fresh heat-bleachable antihalation layer coatings were completely bleached when heat processed at 140° C. for 5 seconds. The compositions comprising HABI compounds H-1, H-24, H-25, and H-26 also provided adequate heat-bleaching even under accelerated storage conditions.

TABLE VI

| | | Optical Density at 670 nm | | | | |
|---|---|---|---|---|---|---|
| Example | HABI | Fresh | Processed at 120° C. for 5 sec. | Processed at 140° C. for 5 sec. | Accelerated Storage at 50° C., 50% RH for 13 days | Processed at 50° C., 50% RH for 13 days, then processed at 140° C. for 5 sec |
| 11 | H-22 | 0.91 | 0.21 | 0.00 | 0.68 | 0.42 |
| 12 | H-23 | 0.89 | 0.00 | 0.00 | 0.47 | 0.31 |
| 13 | H-24 | 1.40 | 0.81 | 0.00 | 0.85 | 0.11 |
| 14 | H-25 | 1.39 | 0.52 | 0.01 | 0.66 | 0.09 |
| 15 | H-26 | 1.39 | 1.00 | 0.00 | 0.94 | 0.09 |
| 16 | H-1 | 1.54 | 0.43 | 0.00 | 1.04 | 0.08 |
| 17 | H-27 | 1.70 | 1.25 | 0.39 | 1.15 | 0.65 |

EXAMPLES 18–20

Antihalation Compositions with Various Oxonol Dyes

Three heat-bleachable antihalation compositions of this invention were prepared as described in Examples 11–17 using HABI compound H-1 and different oxonol dyes. Heat-bleachable antihalation coatings were prepared, heat-processed and evaluated as described in Examples 11–17. The optical densities at the respective coating $\lambda_{max}$ values were measured before and after heat-processing.

The results, shown in TABLE VII below, indicate that all of the compositions were acceptably bleached during heat-processing.

TABLE VII

| | | Optical densities at coating $\lambda_{max}$ | | | |
|---|---|---|---|---|---|
| Example | Dye | Coating $\lambda_{max}$ (nm) | Fresh | Processed at 140° C. for 10 seconds | % Bleached |
| 18 | O-28 | 718 | 0.29 | 0.04 | 86 |
| 19 | O-27 | 533 | 0.20 | 0.03 | 85 |
| 20 | O-26 | 567 | 0.65 | 0.02 | 96.9 |

EXAMPLE 21–47 AND COMPARATIVE EXAMPLES 3–7

The dyes shown in Tables VIII and IX below were evaluated by preparing a solution of 1.26 g of BUTVAR® B-79, the indicated amount of the given dye, the indicated amount of the HABI derived from triarylimidazole H-1, and 82.5 mg of L-9342 antistatic agent at 12.75% solids in MEK. The solution was coated on 4 mil (102 $\mu$m) thick polyethylene terephthalate film using a #60 wire-wound rod, and dried at 160° F. (71° C.) for 1 minute. The films were thermally processed and evaluated in the same manner as those of Examples 1–8.

The results, shown in Tables VIII and LX below demonstrate that inventive examples all bleach greater than 70% using less than or equal to 3.00 molar equivalents of HABI per mole of dye. Examples employing comparative dyes CD-2 to CD-6 all bleach less than 70% even when more than 3.0 molar equivalents of HABI were used.

Comparative Dyes CD-2 to CD-6 have the structures shown below:

CD-2

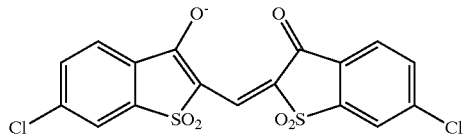

$(C_2H_5)_3NH^+$

CD-3

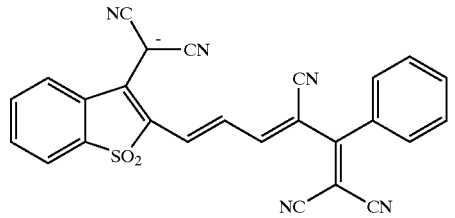

$(C_2H_5)_3NH^+$

-continued

CD-4

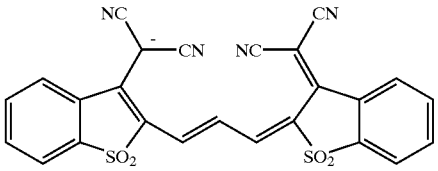

$(C_2H_5)_3NH^+$

CD-5

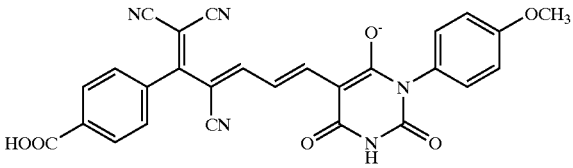

$(C_2H_5)_3NH^+$

-continued

CD-6

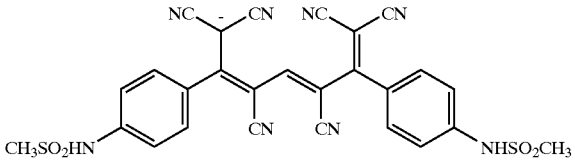

$(C_2H_5)_3NH^+$

TABLE VIII

| Example | Dye | Wt. Dye (mg) | Wt. HABI Derived From H-1 (mg) | $\lambda_{max}$ | Absorbance before Bleaching | Absorbance after Bleaching | % Bleached | HABI/Dye mole ratio |
|---|---|---|---|---|---|---|---|---|
| 21 | O-29 | 14 | 46.1 | 788 nm | 0.6709 | −0.0024 | 100% | 3.00 |
| 22 | O-30 | 14 | 55 | 556 nm | 0.7121 | 0.1392 | 80% | 2.95 |
| 23 | O-31 | 14 | 55 | 622 nm | 0.7089 | 0.0128 | 98% | 2.96 |
| 24 | O-32 | 14 | 55 | 598 nm | 0.7403 | 0.0195 | 97% | 2.89 |
| 25 | O-34 | 14 | 50.4 | 598 nm | 0.6007 | 0.0535 | 91.1% | 3.00 |
| 26 | O-35 | 14 | 55 | 598 nm | 1.0379 | 0.0208 | 98% | 2.75 |
| 27 | O-36 | 14 | 55 | 496 nm | 0.8976 | 0.0656 | 93% | 2.62 |
| 28 | O-38 | 14 | 55 | 620 nm | 0.6955 | 0.0042 | 99% | 2.44 |
| 29 | O-39 | 14 | 55 | 622 nm | 0.7415 | 0.0076 | 99% | 2.96 |
| 30 | O-40 | 14 | 55 | 736 nm | 1.0223 | 0.0835 | 92% | 2.85 |
| 31 | O-41 | 14 | 55 | 588 nm | 0.8941 | 0.2567 | 71% | 2.83 |
| 32 | O-42 | 14 | 97.7 | 504 nm | 1.1669 | 0.01034 | 91.1% | 3.00 |
| 33 | O-43 | 14 | 55 | 610 nm | 1.3533 | 0.1844 | 86% | 1.82 |
| 34 | O-44 | 14 | 55 | 626 nm | 1.0264 | 0.2428 | 76% | 2.71 |
| 35 | O-45 | 14 | 55 | 738 nm | 0.7744 | 0.0034 | 99.6% | 2.31 |
| 36 | O-46 | 14 | 49.0 | 582 nm | 0.5853 | 0.0711 | 87.9% | 3.00 |
| 37 | O-48 | 14 | 55 | 576 nm | 0.6423 | 0.0953 | 85% | 2.61 |
| 38 | O-49 | 14 | 55 | 556 nm | 0.8322 | 0.1656 | 80% | 2.77 |
| 39 | O-50 | 14 | 50.4 | 636 nm | 0.8325 | 0.0172 | 97.9% | 3.00 |
| 40 | O-51 | 14 | 47.9 | 630 nm | 0.7433 | 0.0105 | 98.6% | 3.00 |
| 41 | O-52 | 14 | 39.3 | 794 nm | 0.4827 | 0.0190 | 96.1% | 3.00 |
| 42 | O-53 | 14 | 55 | 616 nm | 0.2059 | 0.0013 | 99% | 2.01 |
| 43 | O-54 | 14 | 49.6 | 504 nm | 0.7797 | 0.770 | 90.1% | 3.00 |
| 44 | O-55 | 14 | 55 | 538 nm | 0.505 | 0.0022 | 100% | 2.32 |
| 45 | O-56 | 14 | 54.3 | 622 nm | 0.9828 | 0.0200 | 98% | 3.00 |
| 46 | O-57 | 14 | 55 | 656 nm | 0.972 | 0.0229 | 98% | 2.73 |
| 47 | O-58 | 14 | 55 | 672 nm | 1.0647 | 0.0246 | 98% | 2.80 |

TABLE VIII

| Comparative Example | Dye | Wt. Dye (mg) | Wt. Dye Derived From HABI H-1 (mg) | $\lambda_{max}$ | Absorbance before Bleaching | Absorbance after Bleaching | % Bleached | HABI/Dye mole ratio |
|---|---|---|---|---|---|---|---|---|
| 3 | CD-2 | 14 | 58.5 | 452 nm | 0.3404 | 0.3068 | 9.8% | 3.00 |
| 4 | CD-3 | 14 | 56.7 | 692 nm | 0.6472 | 0.2919 | 54.9% | 3.00 |
| 5 | CD-4 | 14 | 55 | 742 nm | 0.4213 | 0.2339 | 44% | 3.10 |
| 6 | CD-5 | 14 | 55 | 576 nm | 0.2424 | 0.1095 | 55% | 3.15 |
| 7 | CD-6 | 14 | 55 | 516 nm | 0.3968 | 0.3819 | 4% | 3.54 |

The invention has been described in detail with particular reference to certain preferred embodiments thereof, but it will be understood that variations and modifications can be effected within the spirit and scope of the invention.

We claim:

1. A heat-bleachable antihalation composition comprising:

a) a hexaarylbiimidazole, and b) an oxonol dye that is represented by one of the following Structures I-A, I-B, and I-C:

I-A

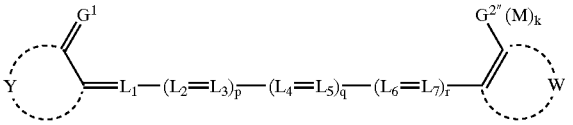

I-B

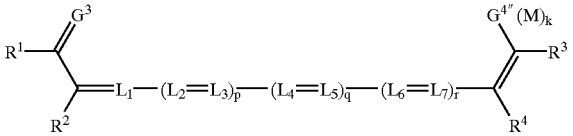

I-C

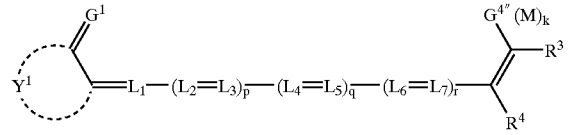

wherein W, Y, and $Y^1$ independently represent the non-metallic atoms necessary to form carbocyclic or heterocyclic rings, $R^1$ and $R^3$ are independently carbocyclic or heterocyclic aromatic groups, $R^2$ and $R^4$ are independently electron-withdrawing groups, $G^1$, $G^2$, $G^3$, and $G^4$ are independently oxygen or a dicyanomethylene group, $L_1$, through $L_7$ independently represent a substituted or unsubstituted methine group, M represents a counterion, k is the number of M counterions necessary to provide neutral charge for Structure I-A, I-B, or I-C, p and q, are independently 0 or 1, and r is 0, 1, or 2.

2. The antihalation composition of claim 1 wherein p is 1 and at least one of q and r is 1.

3. The antihalation composition of claim 1 wherein said oxonol dye has a $\lambda_{max}$ of at least 400 nm.

4. The antihalation composition of claim 1 wherein p is 1.

5. The antihalation composition of claim 1 wherein $W^1$, Y, and $Y^1$ independently represent the non-metallic atoms necessary to form 5- to 7-membered carbocyclic or heterocyclic rings, $R^1$ and $R^3$ are independently phenyl or pyridinyl groups, $R^2$ and $R^4$ are independently cyano, carboxamido, benzoyl, carbonyloxy, sulfone, or sulfonamido groups, $G^1$, $G^2$, $G^3$, and $G^4$ are oxygen, and at least one of r and q is 1.

6. The antihalation composition of claim 1 wherein said oxonol dye is represented by the following Structure II:

(II)

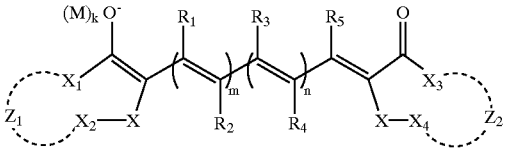

wherein $R_1$, $R_2$, $R_3$, $R_4$, and $R_5$ are independently hydrogen or an alkyl, aryl, cycloalkyl, non-aromatic heterocyclyl, halo, $R_6O$—, $R_7S(O)_t$—, $R_8$—(C═O)—, $R_9O$—(C═O)—, nitro, cyano, $R_{10}R_{11}N$—(C═O)—, $R_{12}R_{13}N$—$SO_2$—, or $R_{14}R_{15}N$— group, or any of $R_1$ and $R_2$, $R_2$ and $R_3$, $R_3$ and $R_4$, or $R_4$ and $R_5$, or any of $R_1$ and $R_3$, $R_2$ and $R_4$, or $R_3$ and $R_5$, can be taken together form a 5- or 6-membered carbocyclic or heterocyclic fused ring, or $R_1$, $R_3$, and $R_5$ can be taken together form 5- or 6-membered fused rings, $R_6$, $R_7$, $R_8$, $R_9$, $R_{10}$, $R_{11}$, $R_{12}$, $R_{13}$, $R_{14}$, and $R_{15}$ are independently hydrogen or an alkyl, cycloalkyl, aryl, or non-aromatic heterocyclyl group, X is a C═O, C═S, S, SO, $SO_2$, or $C{=}C(CN)_2$ group, $X_1$, $X_2$, $X_3$, and $X_4$ are independently C, N, O, or S atoms, M represents a counterion, k is the number of M counterions necessary to provide neutral charge for Structure II, $Z_1$ and $Z_2$ independently represent a covalent bond between $X_1$ and $X_2$, or $X_3$ and $X_4$, or the non-metallic atoms necessary to complete a substituted or unsubstituted 6- or 7-membered carbocylic or heterocyclic ring with $X_1$ and $X_2$ or $X_3$ and $X_4$, m and n are independently 0, 1, or 2 provided that both are not 0, and t is 0, 1, or 2.

7. The antihalation composition of claim 6 wherein $R_1$, $R_2$, $R_3$, $R_4$, and $R_5$ are independently hydrogen or an alkyl or aryl group, or any of two appropriate combinations of $R_1$ to $R_5$ can be taken together to form a 5- or 6-membered carbocyclic or heterocyclic ring, or $R_1$, $R_3$, and $R_5$ can be taken together to form a 5- to 6-membered fused carbocyclic ring, X is a C═O, $SO_2$ or $C{=}C(CN)_2$ group, $Z_1$ and $Z_2$ independently represent the carbon atoms necessary to complete a 6-membered ring that can have one or more halo, alkyl, alkoxy, or oxo group substituents, and m and n are independently 1 or 2.

8. The antihalation composition of claim 7 wherein $R_1$, $R_2$, $R_3$, $R_4$, and $R_5$ are independently hydrogen or a methyl or ethyl group, and at least one of m and n is 1, and the other is 1 or 2.

9. The antihalation composition of claim 6 where in m and n are independently 1 or 2, and $X_1$, $X_2$, $X_3$, and $X_4$ are independently C, S, or N atoms.

10. The antihalation composition of claim 6 wherein $Z_1$ and $Z_2$ independently represent the non-metallic atoms necessary to complete a 5- or 6-membered ring that is fused to an aromatic ring.

11. The antihalation composition of claim 6 wherein $R_1$, $R_2$, $R_3$, $R_4$, and $R_5$ are independently hydrogen or a methyl, ethyl, or $R_8$(C═O)— group, $R_8$, $R_{10}$, and $R_{11}$ are independently a methyl, ethyl, or cyclohexyl group, and each of m and n is 1.

12. The antihalation composition of claim 1 wherein said oxonol dye is represented by the following Structure III:

(III)

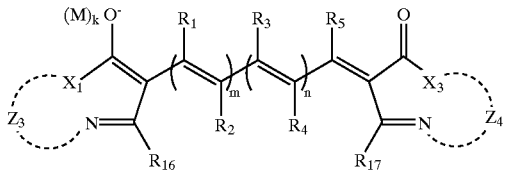

wherein $R_1$, $R_2$, $R_3$, $R_4$, and $R_5$ are independently hydrogen or an alkyl, aryl, cycloalkyl, non-aromatic heterocyclyl, halo, $R_6O$—, $R_7S(O)_t$—,$R_8$—(C═O)—, $R_9O$—(C═O)—, nitro, cyano, $R_{10}R_{11}N$—(C═O)—, $R_{12}R_{13}N$—$SO_2$—, or $R_{14}R_{15}N$— group, or any of $R_1$ and $R_2$, $R_2$ and $R_3$, $R_3$ and $R_4$, or $R_4$ and $R_5$, or any of $R_1$ and $R_3$, $R_2$ and $R_4$, or $R_3$ and $R_5$, can be taken together form a 5- or 6-membered carbocyclic or heterocyclic ring, or $R_1$, $R_3$, and $R_5$, can be taken together form 5- or 6-membered fused rings, $R_6$, $R_7$, $R_8$, $R_9$, $R_{10}$, $R_{11}$, $R_{12}$, $R_{13}$, $R_{14}$, and $R_{15}$, are independently hydrogen or an alkyl, cycloalkyl, aryl, or non-aromatic heterocyclyl group, M represents a counterion, k is the number of M counterions necessary to provide neutral charge for Structure III, m and n are independently 0, 1, or 2 provided that both are not 0, t is 0, 1, or 2, $X_1$, and $X_3$ are independently C, N, O, or S atoms, $Z_3$ and $Z_4$ independently represent a covalent bond between $X_1$ and its associated nitrogen atom, or $X_3$ and its associated nitrogen atom, or the non-metallic atoms necessary to provide a 6- or 7-membered heterocyclic ring with $X_1$ and its associated nitrogen atom, or $X_3$ and its associated nitrogen atom, and $R_{16}$ and $R_{17}$ are independently hydrogen or an alkyl, aryl, cycloalkyl, alkoxy, aryloxy, non-aromatic heterocyclyl, or carboxyalkyl group.

13. The antihalation composition of claim 12 wherein $R_1$, $R_2$, $R_3$, $R_4$, and $R_5$ are independently hydrogen or an alkyl, cycloalkyl, or aryl group, $X_1$ and $X_3$ are independently C, N, or S atoms, m and n are independently 1 or 2, $Z_3$ and $Z_4$ independently represent a covalent bond between $X_1$ and its associated nitrogen atom, and $X_3$ and its associated nitrogen atom, and $R_{16}$ and $R_{17}$ are independently hydrogen or a carboxyalkyl group.

14. The antihalation composition of claim 13 wherein $R_1$, $R_2$, $R_3$, $R_4$, and $R_5$, are independently hydrogen or a methyl or ethyl group, $X_1$ and $X_3$ are independently C or N atoms, m and n are each 1, and $R_{16}$ and $R_{17}$ are independently carboxyalkyl groups.

15. The antihalation composition of claim 1 comprising one or more of the following oxonol dyes O-1 to 0–67:

(O-1)

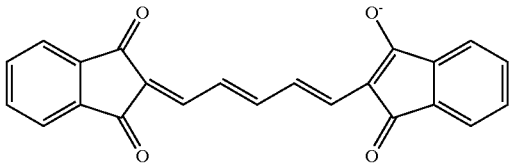

$(C_2H_5)_3NH^+$ (O-2)

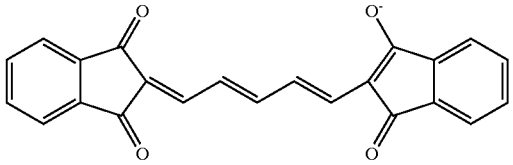

$K^+$ (O-3)

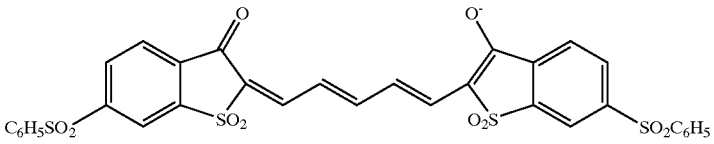

$(C_2H_5)_3NH^+$ (O-4)

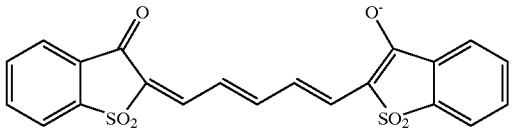

$K^+$

-continued
(O-5)
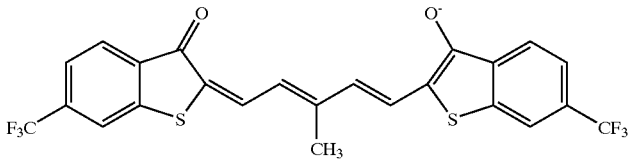
$(C_2H_5)_3NH^+$
(O-6)
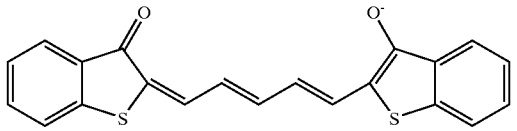
$(C_2H_5)_3NH^+$
(O-7)
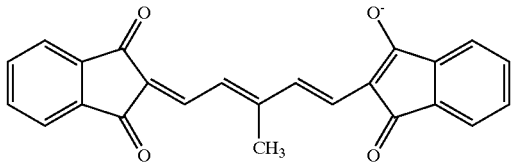
$(CH_3)_4N^+$
(O-8)
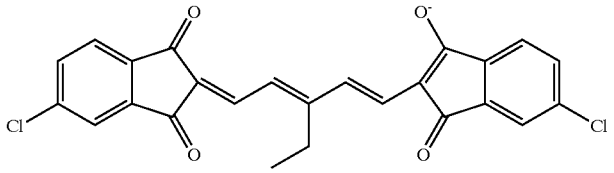
$Na^+$
(O-9)
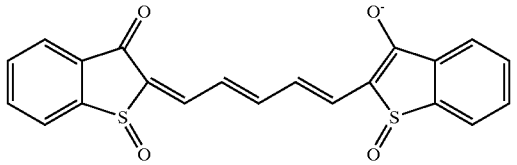
$(C_2H_5)_3NH^+$
(O-10)
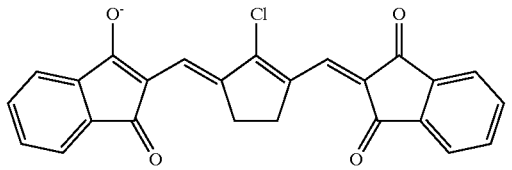
$(CH_3)_3NH^+$
(O-11)
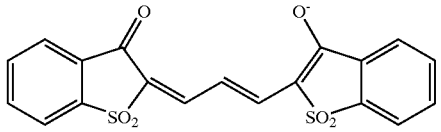
$(C_2H_5)_3NH^+$ -continued
(O-12)
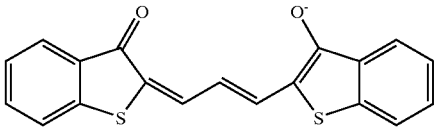
$(C_2H_5)_3NH^+$
(O-13)
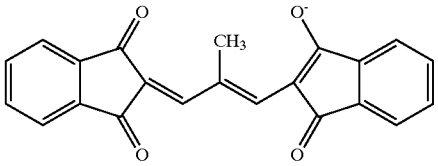
$(CH_3)_4N^+$
(O-14)
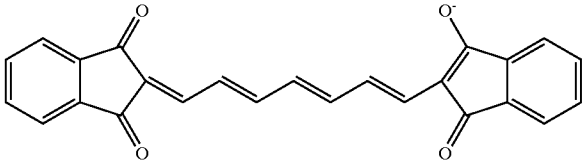
$Na^+$
(O-15)
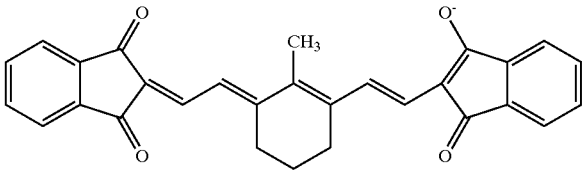
$(C_4H_9)_4N^+$
(O-16)
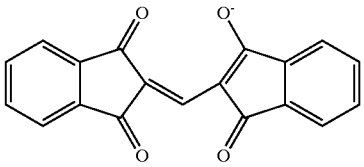
$(CH_3)_3NH^+$
(O-17)
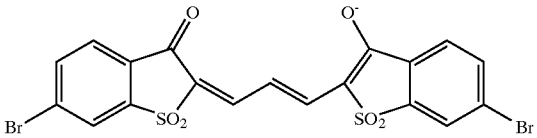
$(C_2H_5)_3NH^+$
(O-18)
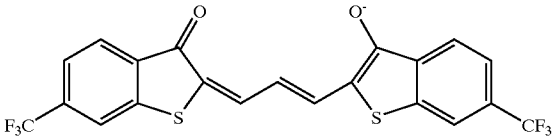
$(C_2H_5)_3NH^+$ -continued
(O-19)
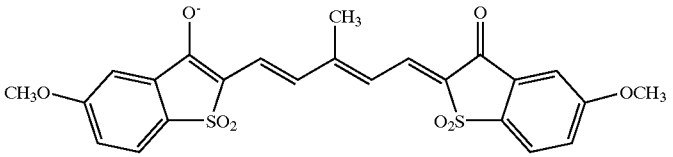
$(C_2H_5)_3NH^+$
(O-20)
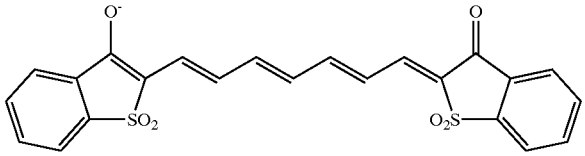
$(C_2H_5)_3NH^+$
(O-21)
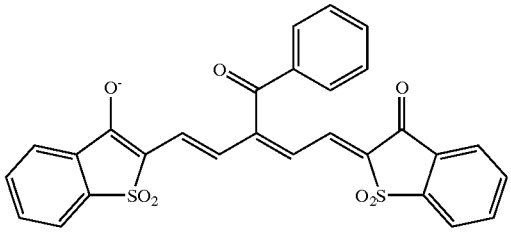
$(C_2H_5)_3NH^+$
(O-22)
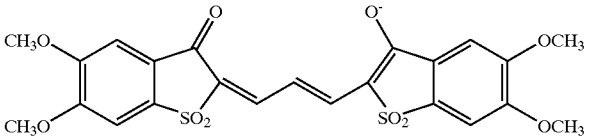
$(C_2H_5)_3NH^+$
(O-23)
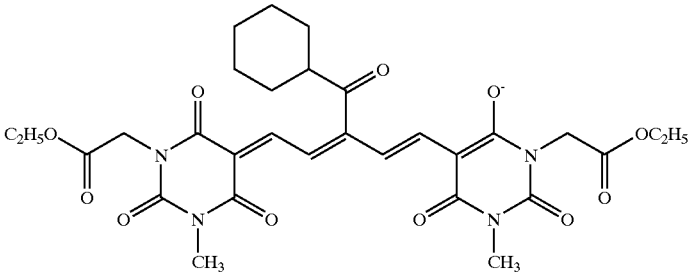
$(C_2H_5)_3NH^+$
(O-24)
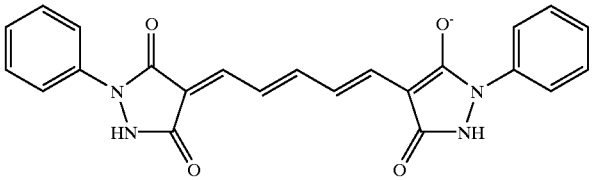
$(C_2H_5)_3NH^+$ -continued
(O-25)
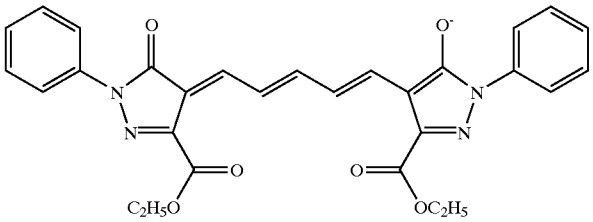
$(C_2H_5)_3NH^+$
(O-26)
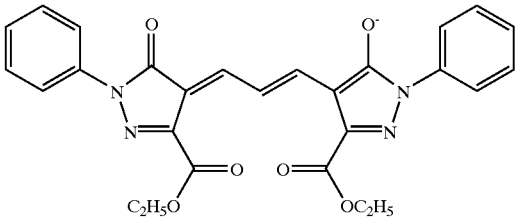
$(C_2H_5)_3NH^+$
(O-27)
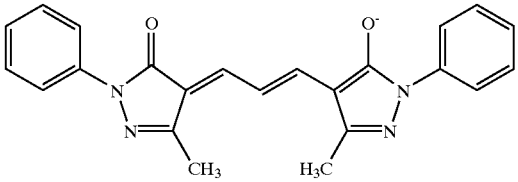
$(C_2H_5)_3NH^+$
(O-28)
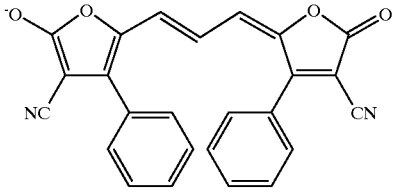
$(C_2H_5)_3NH^+$
(O-29)
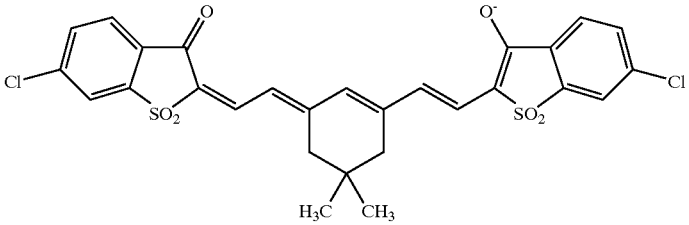
$(C_2H_5)_3NH^+$
(O-30)
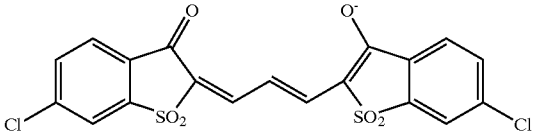
$(C_2H_5)_3NH^+$ -continued
(O-31)
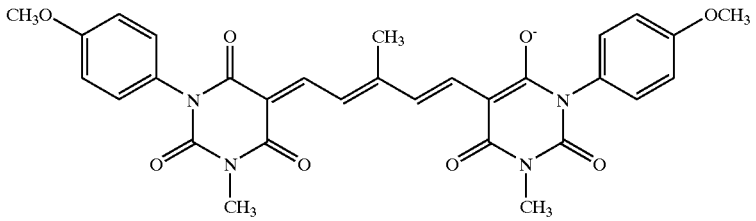
$(C_2H_5)_3NH^+$
(O-32)
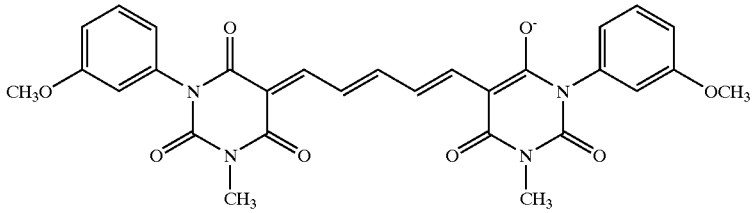
$(C_2H_5)_3NH^+$
(O-33)
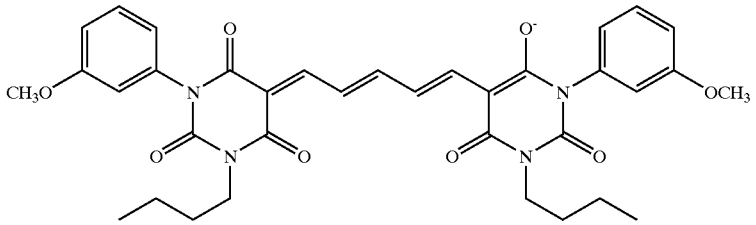
$(C_2H_5)_3NH^+$
(O-34)
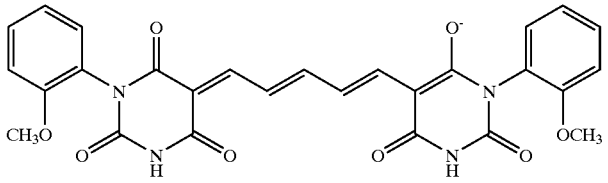
$(C_2H_5)_3NH^+$
(O-35)
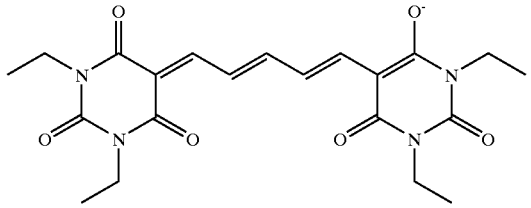
$(C_2H_5)_3NH^+$
(O-36)
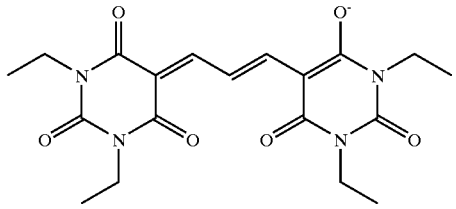
$(C_2H_5)_3NH^+$ -continued
(O-37)
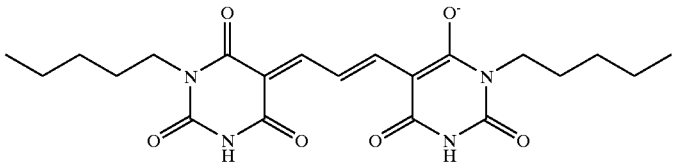
$(C_2H_5)_3NH^+$
(O-38)
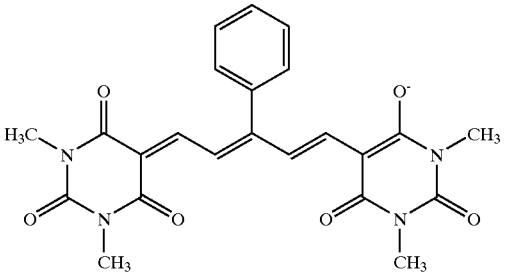
$Na^+$
(O-39)
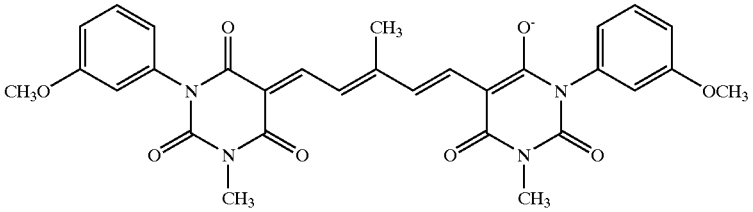
$(C_2H_5)_3NH^+$
(O-40)
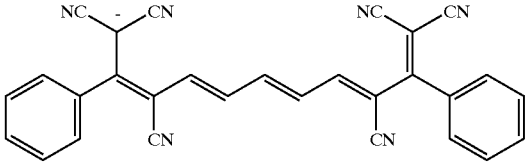
$(C_2H_5)_3NH^+$
(O-41)
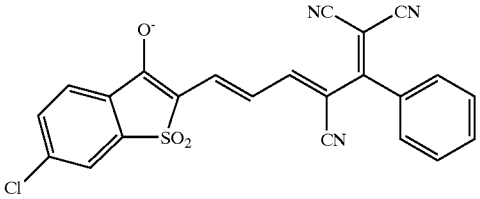
$(C_2H_5)_3NH^+$
(O-42)
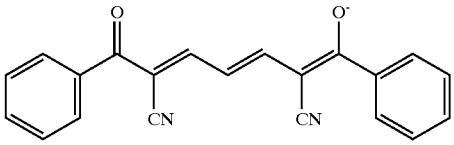
$(C_2H_5)_3NH^+$
(O-43)
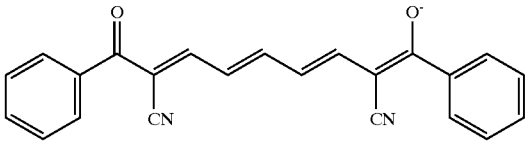
$(C_2H_5)_3NH^+$ -continued
(O-44)
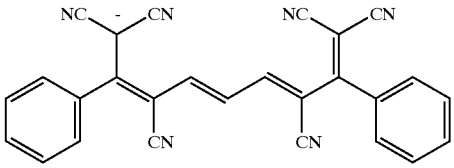
$(C_2H_5)_3NH^+$
(O-45)
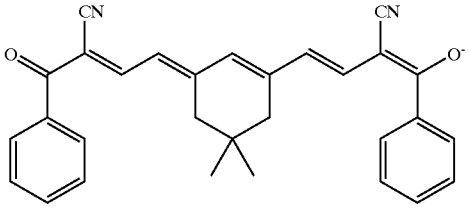
$(C_2H_5)_3NH^+$
(O-46)
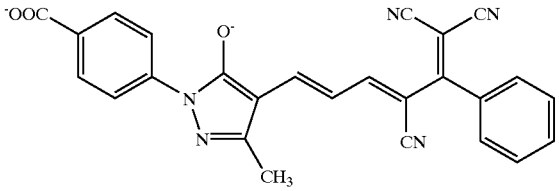
$[(C_2H_5)_3NH^+]_2$
(O-47)
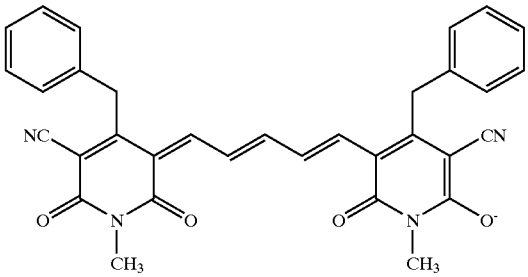
$Na^+$
(O-48)
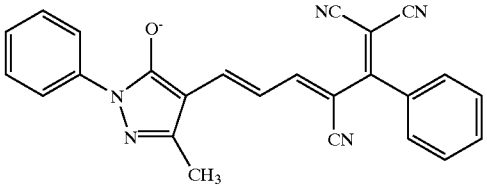
$(C_2H_5)_3NH^+$
(O-49)
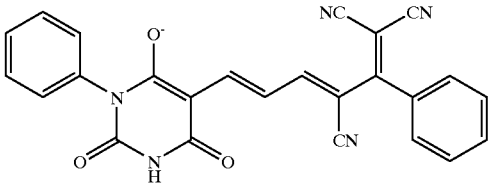
$(C_2H_5)_3NH^+$ -continued
(O-50)
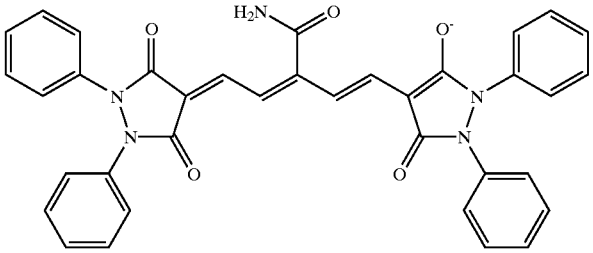
$Na^+$
(O-51)
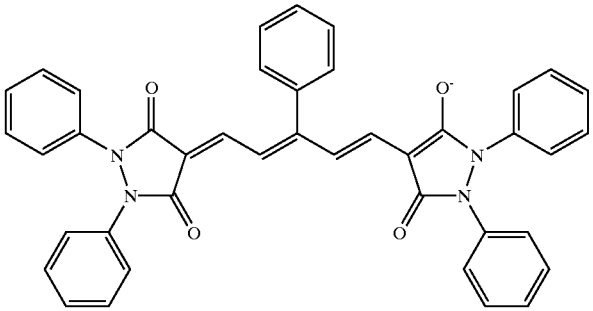
$Na^+$
(O-52)
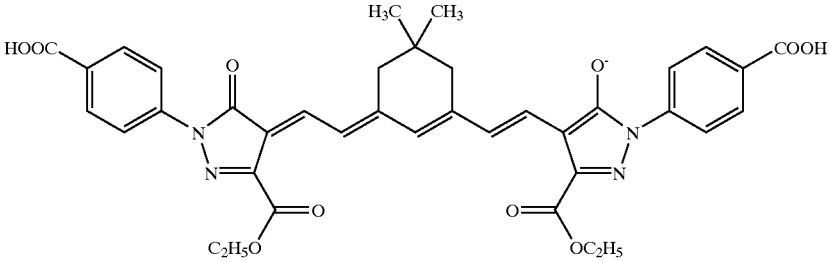
$(C_2H_5)_3NH^+$
(O-53)
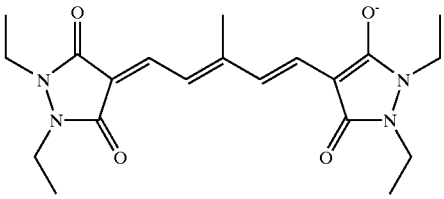
$(C_2H_5)_3NH^+$
(O-54)
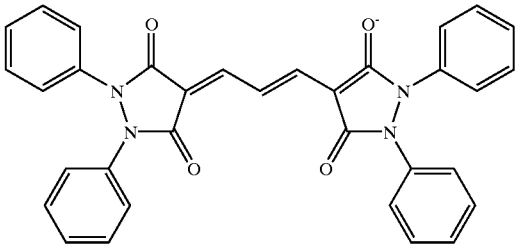
$(C_2H_5)_3NH^+$ -continued
(O-55)
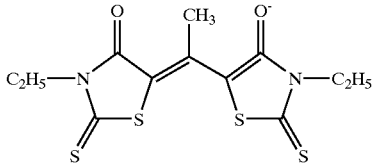
$(C_2H_5)_3NH^+$
(O-56)
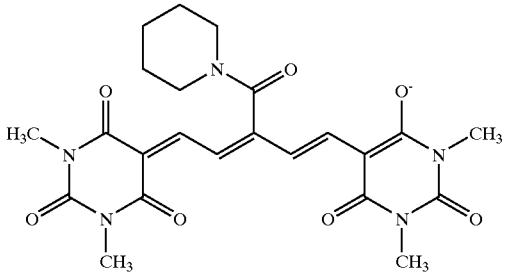
$(C_2H_5)_3NH^+$
(O-57)
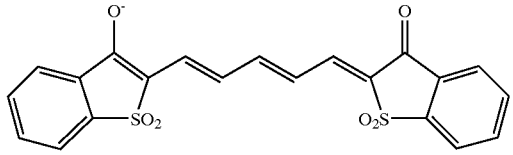
$(C_2H_5)_3NH^+$
(O-58)
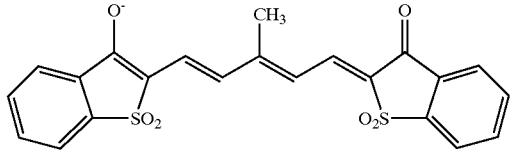
$(C_2H_5)_3NH^+$
(O-59)
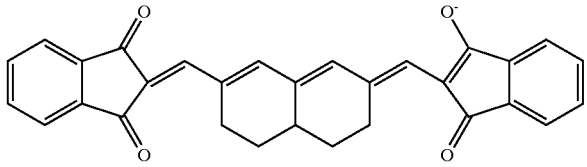
$Na^+$
(O-60)
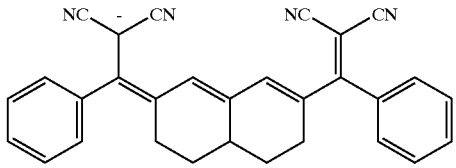
$(C_2H_5)_3NH^+$
(O-61)
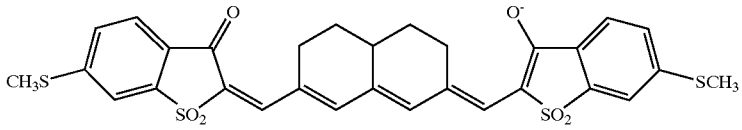
$(C_2H_5)_3NH^+$ -continued
(O-62)
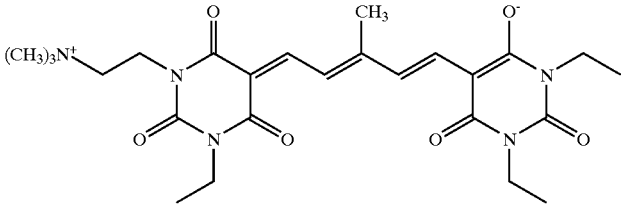
(O-63)
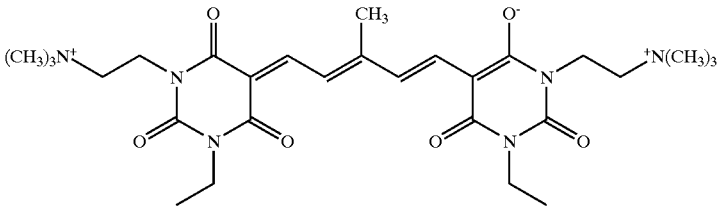
$BF_4^-$
(O-64)
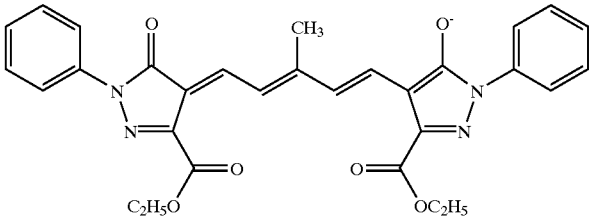
$(C_2H_5)_3NH^+$
(O-65)
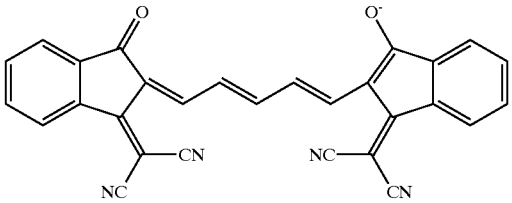
$(C_2H_5)_3NH^+$
(O-66)
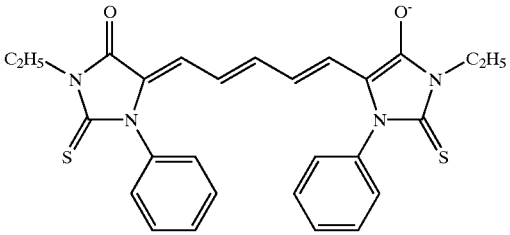
and
$(n\text{-}C_4H_9)_4N^+$
(O-67)
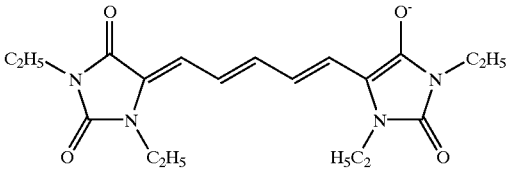
$(C_3H_7)_4N^+$ 16. The antihalation composition of claim 1 that satisfies the following "dye bleaching test":

A 1 molar equivalent of said oxonol dye and 3 molar equivalents of said HABI derived from H-1 are applied from an organic solvent or mixture thereof with a polyvinyl butyral binder present at from 95–99% of the solids, to a polyethylene terephthalate support, and dried to provide a layer having a thickness of about 4 mμ, wherein there is sufficient oxonol dye in said dried layer to provide a layer absorbance (at its $\lambda_{max}$) attributable to said oxonol dye of at least 0.2, and said dried layer is then heated at 120° C. for 20 seconds, and the optical density (absorbance) is again measured at the oxonol dye $\lambda_{max}$, whereby the optical density of said oxonol dyes is decreased by at least 70%, (H-1)

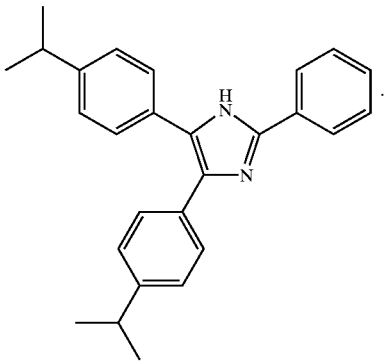

17. The antihalation composition of claim 1 wherein the molar ratio of said hexaarylbiimidazle to said oxonol dye is from about 1:1 to about 100:1.

18. The antihalation composition of claim 1 wherein said oxonol dye is present in an amount of at least 0.01 weight %, and the amount of said hexaarylbiimidazole is at least 0.05 weight %.

19. The antihalation composition of claim 1 further comprising:

c) a film-forming binder, and/or d) a polar solvent.

20. The antihalation composition of claim 19 wherein said film-forming, binder is a polystyrene, polyacrylate or polymethacrylate, polycarbonate, cellulose ester, polysulfonamide, polyvinyl halide, polyvinylidene halide, polyvinyl acetate, polyvinyl acetal, butadiene polymer, polyester, ethylene-vinyl acetate copolymer, poly(vinyl alcohol), or gelatin.

21. The antihalation composition of claim 19 wherein said polar solvent is methyl ethyl ketone, acetone, methanol, ethanol, methyl isobutyl ketone, cyclohexanone, toluene, water, or mixtures thereof.

22. The antihalation composition of claim 1 wherein said hexaarylbiimidazole is represented by the following Structure IV:

(IV)

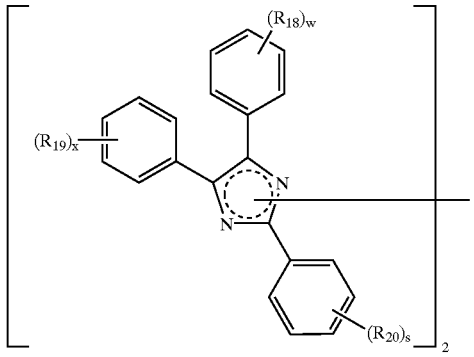

wherein $R_{18}$, $R_{19}$, and $R_{20}$ are independently hydrogen, alkyl, alkoxy, cycloalkyl, aryl, aryloxy, non-aromatic heterocyclyl, alkylthio, arylthio, cyano, sulfonamido, benzoyl, carbonyloxy, carboxamido, or halo groups, and w, x, and s are independently 0, 1, 2, 3, 4, or 5.

23. The antihalation composition of claim 22 wherein each of $R_{18}$, $R_{19}$, and $R_{20}$ is in the meta or para position on the respective phenyl rings.

24. The antihalation composition of claim 22 wherein $R_{18}$, $R_{19}$, and $R_{20}$ are in the meta or para position on the respective phenyl rings, and are independently hydrogen, alkyl, alkoxy, cycloalkyl, aryl, aryloxy, non-aromatic heterocyclyl, alkylthio, arylthio, or halo groups, and one or two of w, x, and s are independently 1 or 2.

25. The antihalation composition of claim 24 wherein $R_{18}$, $R_{19}$, and $R_{20}$ are independently hydrogen, alkyl, alkoxy, or alkylthio groups.

26. The antihalation composition of claim 22 wherein $R_{18}$, $R_{19}$, and $R_{20}$ are independently hydrogen, isopropyl, methoxy, or thiomethyl groups.

27. The antihalation composition of claim 1 wherein said hexaarylbiimidazole is derived from compound H-1:

(H-1)

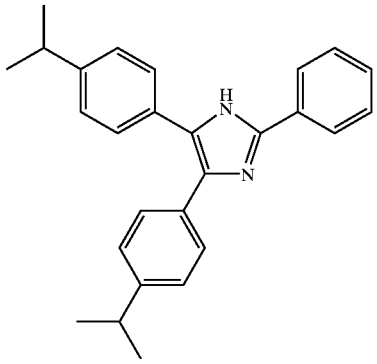

and said oxonol dye is either compound O-1 or O-25, or a mixture thereof (O-1)

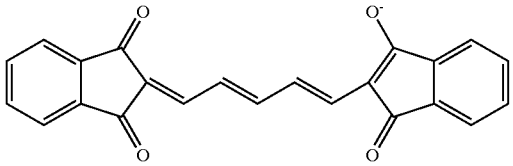

or $(C_2H_5)_3NH^+$ (O-25)

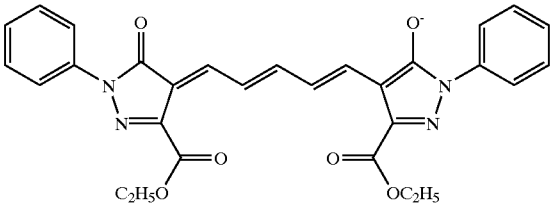

$(C_2H_5)_3NH^+$

28. The antihalation composition of claim 1 further comprising one or more non-heat-bleachable antihalation dyes.

29. A black-and-white photothermographic material that is sensitive at a wavelength greater than 400 nm and comprises a support having thereon one or more thermally-developable imaging layers comprising a hydrophobic binder and in reactive association, a photosensitive silver halide, a non-photosensitive source of reducible silver ions, and a reducing composition for said non-photosensitive source reducible silver ions, and on the backside of said support, an antihalation layer comprising the antihalation composition of claim 1.

30. The photothermographic material of claim 29 wherein said non-photosensitive source of reducible silver ions is a silver fatty acid carboxylate having 10 to 30 carbon atoms in the fatty acid or a mixture of said silver carboxylates.

31. The photothermographic material of claim 29 wherein said reducing composition comprises at least one hindered phenol.

32. The photothermographic material of claim 29 further comprising a high contrast co-developing agent.

33. The photothermographic material of claim 29 that is sensitive to radiation of from about 400 to about 850 nm.

34. The photothermographic material of claim 29 wherein said hexaarylbiimidazole is present in said antihalation layer in an amount of at least $5\times10^{-7}$ mol/m$^2$.

35. The photothermographic material of claim 29 wherein said oxonol dye is present in said antihalation layer in an amount of at least $5\times10^{-7}$ mole/m$^2$, and the molar ratio of said hexaarylbiimidazole to said oxonol dye is from about 1:1 to about 100:1.

36. A method of forming a visible image comprising:

A) imagewise exposing the black-and-white photothermographic material of claim 29 to electromagnetic radiation at a wavelength greater than 400 nm to form a latent image, B) simultaneously or sequentially, heating said exposed photothermographic material to develop said latent image into a visible image.

37. The method of claim 36 wherein said photothermographic material comprises a transparent support, and said image-forming method further comprising:

C) positioning said exposed and heat-developed photothermographic material between a source of imaging radiation and an imageable material that is sensitive to said imaging radiation, and D) exposing said imageable material to said imaging radiation through the visible image in said exposed and heat-developed photothermographic material to provide an image in said imageable material.

* * * * *